US008486596B2

(12) United States Patent
Watanabe et al.

(10) Patent No.: US 8,486,596 B2
(45) Date of Patent: Jul. 16, 2013

(54) TONER, IMAGE FORMING METHOD, AND PROCESS CARTRIDGE

(75) Inventors: Masaki Watanabe, Numazu (JP); Hiroshi Yamashita, Numazu (JP); Tsuyoshi Sugimoto, Mishima (JP); Naohiro Watanabe, Shizuoka-ken (JP); Shinichi Wakamatsu, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 569 days.

(21) Appl. No.: 12/492,511

(22) Filed: Jun. 26, 2009

(65) Prior Publication Data

US 2009/0325099 A1 Dec. 31, 2009

(30) Foreign Application Priority Data

Jun. 27, 2008 (JP) ..... 2008-168191

(51) Int. Cl.
*G03G 9/087* (2006.01)

(52) U.S. Cl.
USPC ..... 430/108.4; 430/109.4; 430/123.5; 430/110.3; 430/137.14; 430/108.22

(58) Field of Classification Search
USPC ..... 430/137.14, 108.1, 109.4, 108.4, 430/110.3, 108.22, 123.5
See application file for complete search history.

(56) References Cited

U.S. PATENT DOCUMENTS

| | | | | |
|---|---|---|---|---|
| 4,002,570 | A * | 1/1977 | Lindblad et al. | 430/108.11 |
| 5,445,910 | A * | 8/1995 | Ishikawa et al. | 430/108.11 |
| 6,849,369 | B2 | 2/2005 | Yagi et al. | |
| 7,348,117 | B2 | 3/2008 | Inoue et al. | |
| 7,348,121 | B2 | 3/2008 | Inoue et al. | |
| 2002/0022188 | A1* | 2/2002 | Hashimoto et al. | 430/108.1 |
| 2002/0037467 | A1* | 3/2002 | Watanabe et al. | 430/110.1 |
| 2003/0219670 | A1* | 11/2003 | Sawada et al. | 430/109.4 |
| 2004/0076899 | A1* | 4/2004 | Sugiyama et al. | 430/108.1 |
| 2004/0091800 | A1* | 5/2004 | Yoshino et al. | 430/108.1 |
| 2004/0131961 | A1* | 7/2004 | Watanabe et al. | 430/108.4 |
| 2004/0142265 | A1* | 7/2004 | Tomita et al. | 430/108.4 |
| 2005/0003288 | A1* | 1/2005 | Sugiyama et al. | 430/108.1 |
| 2005/0130050 | A1 | 6/2005 | Takada et al. | |
| 2005/0142476 | A1* | 6/2005 | Kim et al. | 430/108.4 |
| 2005/0250030 | A1* | 11/2005 | McStravick et al. | 430/108.6 |
| 2006/0160007 | A1* | 7/2006 | Kmiecik-Lawrynowicz et al. | 430/108.3 |
| 2006/0240349 | A1* | 10/2006 | Watanabe et al. | 430/108.4 |
| 2006/0269858 | A1* | 11/2006 | McDougall et al. | 430/108.1 |
| 2007/0141500 | A1* | 6/2007 | Sugimoto et al. | 430/110.3 |
| 2008/0070141 | A1* | 3/2008 | Sweeney et al. | 430/108.11 |
| 2008/0241724 | A1* | 10/2008 | McDougall et al. | 430/108.3 |

FOREIGN PATENT DOCUMENTS

| | | | |
|---|---|---|---|
| JP | 3066943 | | 5/2000 |
| JP | 2002-116639 | A | 4/2002 |
| JP | 3492748 | | 11/2003 |
| JP | 2004-170439 | A | 6/2004 |
| JP | 3640918 | | 1/2005 |
| JP | 2005-91760 | A | 4/2005 |
| JP | 2005-172968 | A | 6/2005 |
| JP | 3692829 | | 7/2005 |
| JP | 2005-266557 | A | 9/2005 |
| JP | 4006136 | | 8/2007 |
| JP | 4040010 | | 11/2007 |
| JP | 4076681 | | 2/2008 |

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

A toner produced by a method including dissolving or dispersing toner components comprising a colorant and at least one of a binder resin and a precursor thereof in an organic solvent to prepare a toner components liquid, dispersing the toner components liquid in an aqueous medium including a surfactant, a particulate resin A having the same polarity as the surfactant and a volume average particle diameter of from 5 to 50 nm, and a particulate resin B having a volume average particle diameter of from 10 to 500 nm to form liquid droplets, and removing the organic solvent from the liquid droplets. The particulate resin B is incompatible with the binder resin and swells in the organic solvent.

18 Claims, 5 Drawing Sheets

TONER, IMAGE FORMING METHOD, AND PROCESS CARTRIDGE

BACKGROUND OF THE INVENTION

1. Field of the Invention

The present invention relates to a toner for use in electrophotography. The present invention also relates to an image forming method and a process cartridge using the toner.

2. Discussion of the Background

High-speed and high-grade full-color image forming apparatuses have been developed in the electrophotographic industry recently. Unexamined Japanese Patent Application Publication No. (hereinafter JP-A-) 07-209952 and JP-A-2000-075551 each disclose so-called tandem image forming methods in which different-color toner images are formed on multiple electrophotographic photoreceptors (hereinafter simply "photoreceptors") provided in tandem. The different-color toner images are superimposed on a single intermediate transfer member, in a process called "primary transfer process", and the resultant composite toner image is transferred onto a recording medium, in a process called "secondary transfer process". Tandem image forming methods generally use an intermediate transfer member. The use of an intermediate transfer member is advantageous in that even when non-image areas on photoreceptor are contaminated with fouling, the fouling may not be transferred onto a recording medium directly. However, it is disadvantageous in that total transfer efficiency of toner images is low because toner images are subjected to transfer processes twice.

On the other hand, to respond to increasing demands for higher-grade full-color images, toners are required to be much smaller, so as to reproduce latent images more faithfully. Japanese Patent No. (hereinafter JP-) 3640918 and JP-A-06-250439 disclose toner production methods employing polymerization which are capable of controlling the size, shape, and surface structure of toner. Because toners produced by polymerization methods (hereinafter "polymerization toner") typically have a small size and a controlled shape, polymerization toners may produce high quality images with a low pile height (i.e., thickness of an image) and high reproducibility of dots and thin lines.

Small-size toner particles may exhibit large non-electrostatic adhesion forces to photoreceptors and/or intermediate transfer members. Therefore, small-size toner particles may have low transfer efficiency, especially in the secondary transfer process in high-speed full-color image forming apparatuses. This is because not only non-electrostatic adhesion forces between toner particles and an intermediate transfer member are large, but also multiple toner particles are superimposed on one another while being subjected to an electric field (hereinafter "secondary transfer electric field") in the secondary transfer process for a very short time, disadvantageously, in high-speed apparatuses.

To increase transfer efficiency in the secondary transfer process, one proposed approach involves increasing the strength of the secondary transfer electric field. However, if the secondary transfer electric field is strengthened excessively, transfer efficiency may decrease adversely. Another proposed approach involves widening the secondary transfer nip so that toner particles may be subjected to the secondary transfer electric field for a longer time. To widen the secondary transfer nip when a bias roller applies voltage to an intermediate transfer member by contact therewith, there may be only two possible approaches which involve increasing the contact pressure of the bias roller and increasing the diameter of the bias roller. However, increasing the contact pressure of the bias roller may degrade the resultant image quality, and increasing the diameter of the bias roller may cause upsizing of apparatuses. On the other hand, to widen the secondary transfer nip when a charger applies voltage to an intermediate transfer member without contact therewith, one possible approach involves increasing the number of chargers. All the approaches described above have limitations especially in high-speed apparatuses, and therefore widening of the secondary transfer nip for the purpose of improving transfer efficiency is considered to be substantially impossible.

In attempting to decrease adhesion forces between toner particles and photoreceptors/intermediate transfer members, JP-A-2001-066820 and JP-3692829 disclose methods of adjusting the kind and amount of external additives of toners. In particular, they use large-size external additives. Such toners exhibit lower non-electrostatic adhesion forces to photoreceptors and/or intermediate transfer members. Therefore, the toners may provide high transfer efficiency, stable developing property, and high cleaning ability.

Although such toners may have high transfer efficiency in an early stage, the transfer efficiency may decrease with time because mechanical stresses are continuously applied to the toners in developing devices. In particular, external additives are buried in toner particles and do not reduce adhesion forces between the toner particles and photoreceptors and/or intermediate transfer members, resulting in decrease of transfer efficiency. In high-speed apparatuses, toners are agitated more strongly, in other words, greater mechanical stresses are applied to the toners. Therefore, burial of external additives in toner particles is accelerated.

In order to reliably keep high transfer efficiency for an extended period of time even in high-speed apparatuses, mechanical strength of the surfaces of toner particles may be required to be controllable so that external additives are not buried therein even upon application of mechanical stresses. If the mechanical strength of the surfaces of toner particles is too strong (stiff), the toner particles may be prevented from melting. In addition, in a case in which the toner includes a release agent such as a wax, the release agent may be prevented from exuding from the toner particles, resulting in deterioration of fixing ability of the toner.

SUMMARY OF THE INVENTION

Accordingly, an object of the present invention is to provide a toner having high transfer efficiency.

Another object of the present invention is to provide an image forming method and a process cartridge producing high quality image without defects for an extended period of time.

These and other objects of the present invention, either individually or in combinations thereof, as hereinafter will become more readily apparent can be attained by a toner produced by a method comprising:

dissolving or dispersing toner components comprising a colorant and at least one of a binder resin and a precursor thereof in an organic solvent to prepare a toner components liquid;

dispersing the toner components liquid in an aqueous medium including a surfactant, a particulate resin A having the same polarity as the surfactant and a volume average particle diameter of from 5 to 50 nm, and a particulate resin B having a volume average particle diameter of from 10 to 500 nm to form liquid droplets; and removing the organic solvent from the liquid droplets, wherein the particulate resin B is incompatible with the binder resin and swells in the organic solvent;

and an image forming method and a process cartridge using the above toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

An exemplary method of producing an exemplary toner of the present invention is described below. First, toner components comprising a colorant and at least one of a binder resin and a precursor thereof are dissolved or dispersed in an organic solvent to prepare a toner components liquid. Next, the toner components liquid is dispersed/emulsified in an aqueous medium including a surfactant and a particulate resin A having the same polarity as the surfactant and a volume average particle diameter of from 5 to 50 nm, to prepare a dispersion/emulsion of the toner components liquid. Finally, the organic solvent is removed from the dispersion/emulsion. The resultant toner preferably has a weight average particle diameter of from 1 to 6 μm.

More specifically, a particulate resin B having a volume average particle diameter of from 10 to 500 nm is further included in the aqueous medium. The particulate resin B may be an acrylic resin including C, H, N, and O atoms and may be prepared as an emulsion. The particulate resin B may be added to the aqueous medium either before or after the surfactant and the particulate resin A are added to the aqueous medium. Alternatively, the particulate resin B may be added to the dispersion/emulsion of the toner components liquid. More specifically, the particulate resin B may be added when or after the toner components liquid is dispersed/emulsified in the aqueous medium. The particulate resin B is adhered to the surfaces of droplets of the toner components liquid when the organic solvent is removed from the dispersion/emulsion.

Figure 1:
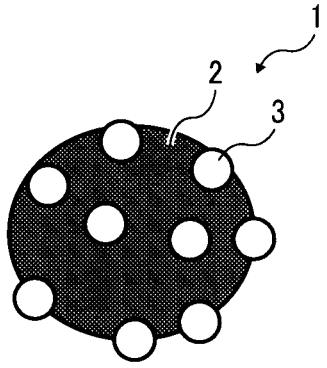
FIG. 1 is a schematic view illustrating an exemplary embodiment of a toner.

FIG. 1 is a schematic view illustrating an exemplary embodiment of a toner prepared as above. A toner 1 includes a mother toner particle 2 including main toner components (a binder resin, a colorant, a release agent, etc.); and a particulate resin A, not shown, and a particulate resin B, denoted by numeral 3, each adhered to the surface of the mother toner particle 2. Because of having a small particle diameter, the particulate resin A may be buried in the mother toner particle 2 or present between the mother toner particle 2 and the particulate resin B. Therefore, the particulate resin A may not be visually observed unless the toner 1 is observed microscopically. Accordingly, the toner 1 looks as if only the particulate resin B, denoted by numeral 3, is adhered to the surface thereof.

The average particle diameter of the toner 1 is controlled by controlling conditions of the dispersion/emulsification of the toner components liquid in the aqueous medium, such as agitation conditions of the aqueous medium.

Generally, as described above, small-size toner particles may exhibit large non-electrostatic adhesion forces to photoreceptors and/or intermediate transfer members. Therefore, small-size toner particles may have low transfer efficiency, especially in the secondary transfer process in high-speed full-color image forming apparatuses. This is because not only non-electrostatic adhesion forces between toner particles and an intermediate transfer member are large, but also the toner particles are subjected to the secondary transfer electric field for a very short time in the secondary transfer process.

The toner 1 includes the particulate resin B, which have a relatively large particle diameter and an appropriate hardness, on the surface thereof. The toner 1 may exhibit weak non-electrostatic adhesion forces to photoreceptors and/or intermediate transfer members and may provide high transfer efficiency even in high-speed apparatuses. The particulate resin B may not adversely affect fixing properties of the toner 1 at all. The particulate resin B may not be buried in the mother toner particle 2 even when large mechanical stress is continuously applied to the toner 1, owing to its hardness. Accordingly, the toner 1 may reliably provide high transfer efficiency for an extended period of time. In addition, the particulate resin B also prevents external additives from being buried in the mother toner particle 2.

As described above, the particulate resin B is added either before or after the toner components liquid is dispersed/emulsified in the aqueous medium. Since droplets of the toner components liquid in the dispersion/emulsion include the organic solvent, the particulate resin B may adhere and ingress to the droplets to some extent. Accordingly, the particulate resin B may be advantageously fixed to the surface of the resultant toner particles after the organic solvent is removed from the droplets.

The particulate resin A adheres to the surface of the mother toner particle 2 and fuses/coalesces to form a relatively hard surface thereon. Therefore, the particulate resin A prevents burial and migration, which may be caused upon application of mechanical stress, of the particulate resin B that has been fixed on the mother toner particles. The particulate resin A is preferably anionic. The particulate resin A being anionic adheres to droplets of the toner components liquid so easily that the droplets are prevented from coalescing with one another, resulting in a narrow size distribution of the resultant toner particles. In addition, the particulate resin A being anionic may contribute to provide negative chargeable toners. The particulate resin A is preferably smaller than the particulate resin B, and preferably has a volume average particle diameter of from 5 to 50 nm.

The toner 1 preferably has a weight average particle diameter of from 1 to 6 μm, and more preferably from 2 to 5 μm. When the weight average particle diameter is too small, the toner may easily scatter in the primary and secondary transfer processes. When the weight average particle diameter is too large, high-definition images may not be produced because dots may not be faithfully reproduced and granularity of half-tone images may deteriorate.

The particulate resin B preferably has a primary volume average particle diameter of from 10 to 500 nm, and more preferably from 100 to 400 nm. The particulate resin B is preferably fixed to mother toner particle 2 without being buried therein so as to function as a spacer. In this case, the toner 1 exhibits a low non-electrostatic adhesion force and keeps high transfer efficiency for an extended period of time even when used in high-speed apparatuses. Accordingly, the toner 1 may be preferably and advantageously used for image forming processes employing an intermediate transfer process including the primary transfer process and the secondary transfer process. More specifically, the toner 1 may be preferably and advantageously used for relatively high-speed image forming processes having a secondary transfer speed of from 300 to 1,000 mm/sec, more preferably 100 to 1,000 mm/sec, and a secondary transfer time of from 0.5 to 60 msec, more preferably from 0.5 to 20 msec. When the secondary transfer speed is too low or the secondary transfer time is too short, the particulate resin B may not function well at all. When the secondary transfer speed is too high, it may be difficult to prevent deterioration of transfer efficiency.

When the primary volume average diameter of the particulate resin B is too small, the particulate resin B may not function well as a spacer and may not lower non-electrostatic adhesion forces of the toner 1. In addition, the toner 1 may not keep high transfer efficiency for an extended period of time when used in high-speed apparatuses. This is because the particulate resin B and external additives may be buried in the mother toner particle 2 with time. When the primary volume average diameter of the particulate resin B is too large, the toner 1 may have poor fluidity and may not be transferred uniformly.

Generally speaking, particulate resins adhered to the surfaces of mother toner particles tend to be buried therein or migrate to concave portions on the surfaces of the mother toner particles upon application of mechanical stresses in developing devices. Therefore, the particulate resins may not reduce adhesion forces of the resultant toner. The same goes for external additives adhered to the surfaces of mother toner particles.

On the other hand, with regard to exemplary toners of the present invention, the particulate resin B having a relatively large size is unlikely to be buried in mother toner particles. Preferably, the particulate resin B is comprised of fine particles of a cross-linked resin including at least one of a styrene polymer, an acrylate polymer, and a methacrylate polymer, so as to have an appropriate hardness. In this case, the particulate resin B may not deform and may function as a spacer even when mechanical stresses are applied thereto. As a result, external additives may not be buried in mother toner particles, thereby preventing increase of adhesion forces of the resultant toner.

The binder resin of the toner preferably includes a polyester-based resin. The binder resin is preferably incompatible with the particulate resin B. Polyester-based resins are substantially incompatible with the cross-linked resins including at least one of a styrene polymer, an acrylate polymer, and a methacrylate polymer. Since droplets of the toner components liquid include an organic solvent when the particulate resin B is added to the dispersion/emulsion, the particulate resin B may adhere to the droplets and may dissolve in the organic solvent in some cases. In a case in which the binder resin includes a polyester-based resin and the particulate resin B includes fine particles of a cross-linked resin including at least one of a styrene polymer, an acrylate polymer, and a methacrylate polymer, the binder resin and the particulate resin B may have poor compatibility. Therefore, the particulate resin B may not dissolve in but adhere to the droplets of the toner components liquid. As a result, the particulate resin B may ingress to the droplets to some extent, and may be advantageously fixed to the surface of the resultant toner particles after the organic solvent is removed from the droplets.

Whether or not the particulate resin B is compatible or incompatible with the binder resin can be determined as follows. First, 50% by weight of the binder resin is dissolved in an organic solvent. Subsequently, a dispersion of the particulate resin B is dropped therein. When the mixture is found to separate into 2 phases by visual observation, it means that the particulate resin B is incompatible with the binder resin. When the mixture is found not to separate by visual observation, it means that the particulate resin B is compatible with the binder resin.

The particulate resin B is preferably capable of aggregating in an aqueous medium including an anionic surfactant. It is not preferable that the particulate resin B stably and separately exists in the dispersion/emulsion without adhering to droplets of the toner components liquid. In a case in which the particulate resin B is capable of aggregating in an aqueous medium including an anionic surfactant, the particulate resin B may migrate from the aqueous medium to the surfaces of droplets of the toner components liquid at the time of or after the dispersion/emulsification. In other words, the particulate resin B is supposed to aggregate in an aqueous medium including an anionic surfactant under normal conditions, but in the presence of droplets of the toner components liquid, the particulate resin B may form heterogeneous complexes with the droplets if there are strong attractive forces therebetween.

Specific examples of usable anionic surfactants include, but are not limited to, fatty acid salts, alkyl sulfates, alkyl aryl sulfonates, alkyl diaryl ether disulfonates, dialkyl sulfosuccinates, alkyl phosphates, naphthalene sulfonic acid formalin condensates, polyoxyethylene alkyl phosphate esters, and glycerol borate fatty acid esters.

In the heterogeneous complex, the particulate resin B is strongly adhered to the droplets of the toner components liquid. To more strongly fix the particulate resin B to the droplets, it is preferable that the droplets are heated to a temperature higher than the glass transition temperature of the binder resin after the particulate resin B migrates and adheres to the surfaces of the droplets.

In a case in which the toner components include the precursor of a binder resin, the precursor preferably includes a compound having an active hydrogen group and a modified polyester resin reactive with the compound having an active hydrogen group. In this case, the resultant toner may have good mechanical strength, and therefore the particulate resin B and external additives are unlikely to be buried in the toner particles. When the compound having an active hydrogen group is cationic, the particulate resin B may be advantageously attracted thereto. In addition, the resultant toner may be fixable within a wide temperature range.

The toner 1 preferably includes the particulate resin B in an amount of from 0.5 to 5% by weight, and more preferably from 1 to 4% by weight, based on 100% by weight of the toner. When the amount is too small, the particulate resin B may not sufficiently function as a spacer, thereby not reducing non-electrostatic adhesion forces of the toner 1. When the amount is too large, the toner 1 may have poor fluidity and may not be transferred evenly. Further, the particulate resin B may not be sufficiently fixed to the toner 1 and may easily release therefrom, possibly contaminating carriers and photoreceptors.

The toner 1 preferably has a hardness of from 1 to 3 GPa, more preferably from 1.2 to 2.6 GPa, measured by a nano-indentation method. In addition, the toner 1 preferably has a hardness of from 40 to 120 $N/mm^2$, more preferably from 60 to 110 $N/mm^2$, measured by a micro-indentation method. The nano-indentation method is a micro-analytical method which measures a hardness of the outermost surface of a toner particle. The micro-indentation method is a macro-analytical method which measures a hardness of an entire toner particle. Accordingly, the hardness measured by the nano-indentation method generally indicates how difficult a particulate resin is buried in a toner particle.

When the hardness measured by the nano-indentation method is too small, particulate resins may be easily buried in the toner particle. When the hardness measured by the nano-indentation method is too large, particulate resins may be less likely to be buried in the toner particle, but the surface of the toner particle may be too hard to sufficiently melt when fixed on a recording medium. When the hardness measured by the nano-indentation method is from 1 to 3 GPa, the toner particle tends to have low non-electrostatic adhesion forces even when no large-size particulate resin is adhered to the surface thereof, regardless of viscosity and/or elasticity of the surface of the toner particle. Accordingly, non-electric adhesion forces of a toner particle can be reduced by a synergistic effect of appropriate hardness and a large-size particulate resin serving as a spacer. When the hardness measured by the nano-indentation method is beyond the range of from 1 to 3 GPa, non-electric adhesion forces of the toner particle may be relatively large.

The hardness measured by the micro-indentation method generally indicates how difficult a toner particle melts when fixed on a recording medium. When the hardness measured by the micro-indentation method is too small, it means that the toner particle is soft. Such a toner particle may be reliably fixed on a recording medium. However, the toner particle may deform so easily in the developing and/or transfer process that the resultant image quality may be poor. Moreover, release agents such as waxes may exude from the toner particle and contaminate carriers and photoreceptors. By comparison, when the hardness measured by the micro-indentation method is too large, it means that the toner particle is hard. Therefore, particulate resins may be less likely to be buried in the toner particle even when mechanical stresses are applied, but the surface of the toner particle may be too hard to sufficiently melt when fixed on a recording medium.

To prevent both burial of the particulate resin B and external additives and deterioration of fixing properties, the toner 1 preferably has hardness measured by both the nano-indentation and micro-indentation methods within the above-described ranges. To achieve this, the particulate resin B preferably functions as a spacer on the outermost surface of the mother toner particle 2 and the mother toner particle 2 is preferably as soft as possible.

The toner 1 preferably has an average circularity of from 0.95 to 0.99. When the average circularity is too small, the toner 1 neither develops latent images evenly nor is transferred onto an intermediate transfer member or a recording medium evenly. As described above, the toner 1 may be produced by dispersing/emulsifying the toner components liquid in an aqueous medium. This method has an advantage in producing small-size and spherical (i.e., with an average circularity of from 0.95 to 0.99) toners.

The ratio (Dw/Dn) of the weight average particle diameter (Dw) to the number average particle diameter (Dn) of the toner 1 is preferably 1.30 or less, and more preferably from 1.00 to 1.30. When the ratio (Dw/Dn) is too small and the toner is used for two-component developers, the toner may fuse on the surface of a carrier with an extended period of agitation in a developing device. As a result, charging ability of the carrier and cleanability of the toner may deteriorate. When the ratio (Dw/Dn) is too small and the toner is used for one-component developers, the toner may easily adhere to developing rollers and toner layer forming blades. When the ratio (Dw/Dn) is too large, it is difficult to produce high definition and high quality images. In addition, the average particle diameter of toner particles in a developer may vary largely after repeated consumption and replenishment of toner particles.

When the ratio (Dw/Dn) is from 1.00 to 1.30, the toner has a good combination of storage stability, low-temperature fixability, and hot offset resistance. In addition, such a toner expresses high gloss in full-color images. When used for two-component developers, the average particle diameter of toner particles in a developer may not vary largely even after repeated consumption and replenishment of toner particles for an extended period of time, and the toner provides reliable developability even after a long-term agitation in developing devices. When used for one-component developers, the average particle diameter of toner particles in a developer may not vary largely even after repeated consumption and replenishment of toner particles, and the toner may not fuse on developing rollers and toner layer forming blades.

When the toner is used for two-component developers, the toner is mixed with a carrier. Suitable carriers preferably have a weight average particle diameter of from 15 to 40 μm. When the weight average particle diameter is too small, the carrier tends to be transferred together with toner onto a recording medium (this phenomenon is hereinafter referred to as carrier deposition). When the weight average particle diameter is too large, carrier deposition is less likely to occur, but background portions of an image tend to be contaminated with toner particles (this phenomenon is hereinafter referred to as background fouling) when the toner concentration in the developer is high. Moreover, small-size dots that form latent images may not be reproduced evenly, thereby degrading granularity of highlight portion of the resultant images.

(Image Forming Method)

An exemplary image forming method of the present invention includes a charging process in which an electrophotographic photoreceptor (hereinafter simply "photoreceptor") is charged by a charger; an irradiating process in which the charged photoreceptor is irradiated by an irradiator to form an electrostatic latent image; a developing process in which the electrostatic latent image is developed by a developing device containing a toner to form a toner image; a primary transfer process in which the toner image is transferred from the photoreceptor onto an intermediate transfer member by a primary transfer device; a secondary transfer process in which the toner image is transferred from the intermediate transfer member onto a recording medium by a secondary transfer device; a fixing process in which the toner image is fixed on the recording medium by a fixing device including heat and pressure applying members; and a cleaning process in which residual toner particles remaining on the photoreceptor without being transferred onto the intermediate transfer member are removed by a cleaning device. The toner used in the developing process is an exemplary toner of the present invention aforementioned. The linear speed (i.e., printing speed) in the secondary transfer process, in which a toner image is transferred onto a recording medium, is preferably from 100 to 1,000 mm/sec, and the transfer time for transferring the toner image onto a recording medium at the secondary transfer nip is preferably from 0.5 to 60 msec.

The image forming method is preferably performed by a tandem image forming apparatus including multiple image forming units each including a photoreceptor, a charger, an irradiator, a developing device, a primary transfer device, and a cleaning device. In such a tandem image forming apparatus, the charging, irradiating, developing, and primary transfer processes are performed independently in each of the image forming units. Therefore, different-color toner images are formed on respective photoreceptors. Accordingly, there is a little difference between the single-color image forming speed and the full-color image forming speed, thereby providing high-speed printing. Single-color toner images each having different colors are superimposed on one another to form a composite full-color toner image. Therefore, if each toner has different properties, such as chargeability, developed amount of toner may vary among the toners and the hue of the composite full-color toner image may not be reproduced faithfully.

Accordingly, it is preferable that toners used for tandem image forming apparatuses have uniform properties, such as developability and adhesion forces to photoreceptor and recording medium, regardless of color. Exemplary toners of the present invention have an advantage in this point.

The charger preferably applies direct-current voltage overlapped with alternate-current voltage. When direct-current voltage overlapped with alternate-current voltage is applied, a surface of a photoreceptor is more reliably and evenly charged to a desired voltage compared to a case only direct-current voltage is applied. The charger preferably includes a charging member to which a voltage is applied, and the charging member charges a photoreceptor by contact therewith. When a photoreceptor is charged by contact with a charging member to which a voltage, especially direct-current voltage overlapped with alternate-current voltage, is applied, the photoreceptor is more uniformly charged.

The fixing device preferably includes a heating roller made of a magnetic metal, which is heated by electromagnetic induction; a fixing roller disposed in parallel with the heating roller; an endless heating belt stretched taut and rotated by the heating and fixing rollers, which is heated by the heating roller; and a pressing roller pressed against the fixing roller with the heating belt therebetween to form a fixing nip, which rotates in the forward direction relative to the heating belt. With such a configuration, the heating belt can be heated within a short time and the temperature thereof is reliably controllable. Even when a recording medium has a rough surface, the heating belt can follow the roughness of the surface, resulting in reliable fixation of toner images thereon.

The fixing device preferably requires no oil or a slight amount of oil. Accordingly, the fixing device preferably uses a toner in which a release agent such as a wax is finely dispersed therein. Since the release agent easily exudes from the toner, the toner is prevented from adhering to a fixing belt even when no oil or a slight amount of oil is applied. Generally, to disperse a release agent in toner, the release agent and binder resins of the toner are preferably incompatible. Release agents may be finely dispersed in toner when toner components mixture is kneaded upon application of shearing force in a toner production process. How a release agent is dispersed in toner can be determined by observation of an ultrathin section of the toner using transmission electron microscopy (TEM). The dispersion diameter of a release agent in toner is preferably as small as possible, however, when the dispersion diameter is too small, the release agent cannot sufficiently exude from the toner. In a case in which a release agent can be observed at a magnification of 10,000 times, the release agent is regarded as being properly dispersed in toner. By contrast, in a case in which a release agent cannot be observed at a magnification of 10,000 times, the release agent is regarded as being excessively dispersed in toner. In this case, the release agent may not sufficiently exude from the toner.

(Measurement of Particle Diameters)

The weight average particle diameter (Dw), volume average particle diameter (Dv), and number average particle diameter (Dn) of toners can be measured by a particle size measuring instrument MULTISIZER III (from Beckman Coulter K. K.) with an aperture diameter of 100 μm and an analysis software Beckman Coulter Multisizer 3 Version 3.51. A typical measuring method is as follows. First, 0.5 ml of a 10% by weight surfactant (an alkylbenzene sulfonate NEOGEN SC-A from Dai-ichi Kogyo Seiyaku Co., Ltd.) is contained in a 100-ml glass beaker, and 0.5 g of a toner is added thereto and mixed using a micro spatula. Next, 80 ml of ion-exchange water are further added to prepare a toner dispersion, and the toner dispersion is dispersed using an ultrasonic dispersing machine W-113MK-II (from Honda Electronics) for 10 minutes. The toner dispersion is then subjected to a measurement using an measuring instrument MULTISIZER III and a measuring solution ISOTON-III (from Beckman Coulter K. K.) while the measuring instrument indicates that the toner dispersion has a concentration of 8±2%. It is important to keep the toner dispersion to have a concentration of 8±2% so as not to cause measurement error.

(Measurement of Average Circularity)

The circularity of a particle is determined by the following equation:

$$\text{Circularity}=Cs/Cp$$

wherein Cp represents the length of the circumference of a projected image of a particle and Cs represents the length of the circumference of a circle having the same area as the projected image of the particle.

The average circularity of a toner can be determined using a flow-type particle image analyzer FPIA-2100 (from Sysmex Corp.) and an analysis software FPIA-2100 Data Processing Program for FPIA version 00-10. A typical measurement method is as follows. First, 0.1 to 0.5 ml of a surfactant (an alkylbenzene sulfonate NEOGEN SC-A from Dai-ichi Kogyo Seiyaku Co., Ltd.) is contained in a 100-ml glass beaker, and 0.1 to 0.5 g of a toner is added thereto and mixed using a micro spatula. Next, 80 ml of ion-exchange water are further added to prepare a toner dispersion, and the toner dispersion is dispersed using an ultrasonic dispersing machine (from Honda Electronics) for 3 minutes. The toner dispersion is then subjected to a measurement of shape distribution using a measuring instrument FPIA-2100 while the measuring instrument indicates that the toner dispersion has a concentration of from 5,000 to 15,000 particles/μl. It is important to keep the toner dispersion to have a concentration of from 5,000 to 15,000 particles/μl so as not to cause measurement error. The concentration of the toner dispersion is controllable by changing the amounts of surfactant and toner. The needed amount of surfactant depends on hydrophobicity of toner. When the amount of surfactant is too large, bubbles may generate in the toner dispersion, which may cause measurement noise. When the amount of surfactant is too small, toner may not be sufficiently dispersed because not being wet sufficiently. The needed amount of toner depends on the particle diameter. When the particle diameter is small, the amount of the toner needs to be small. When the particle diameter is large, the amount of the toner needs to be large. For example, in a case in which a toner has a particle diameter of from 3 to 7 μm, 0.1 to 0.5 g of the toner results in a toner dispersion having a concentration of from 5,000 to 15,000 particles/μl.

(Nano-Indentation Method)

The hardness according to the nano-indentation method can be measured using TRIBO INDENTER (from Hysitron Inc.), equipped with a Berkovich tip, which is a triangular-pyramid indenter, at a maximum indentation depth of 20 nm. The Berkovich tip is impressed on a surface of a toner particle, and the hardness H (GPa) is determined from the size of an impression made after the indenter is impressed for the maximum indentation depth. Randomly selected 100 toner particles are subjected to the measurement and the measured values are averaged. Each of the toner particles is subjected to the measurement for 10 times by changing measuring portions and the measured values are averaged.

(Micro-Indentation Method)

The hardness according to the micro-indentation method can be measured using a hardness measurement instrument FISHERSCOPE® H100 (from Fisher Instruments K. K.), equipped with a Vickers tip, at a maximum indentation depth of 2 μm, a maximum indentation load of 9.8 mN, a creep time of 5 sec, and a loading (unloading) time of 30 sec. The Martens hardness ($N/mm^2$) is determined by impressing the Vickers tip on a surface of a toner particle. Randomly selected 100 toner particles are subjected to the measurement and the measured values are averaged.

(Carrier)

The weight average particle diameter (Dw) of a carrier is calculated from the following equation (1) which represents a particle diameter distribution (i.e., a relation between number frequency and particle diameter) based on weight:

$$Dw=\{1/\Sigma(nD^3)\}\times\Sigma(nD^4) \quad (1)$$

wherein D represents a representative particle diameter (μm) of a channel and n represents the number of particles in the channel. The "channel" is a unit length uniformly dividing the particle diameter range into measurement units in a particle diameter distribution diagram. In the present invention, the unit length is 2 μm. As the representative particle diameter of a channel, the minimum particle diameter in the channel is adopted.

The number average particle diameter (Dp) of a carrier is calculated from the following equation (2) which represents a particle diameter distribution based on number:

$$Dp=\{1/\Sigma N)\}\times\Sigma nD \quad (2)$$

wherein N represents the total number of particles, n represents the number of particles in a channel, and D represents the minimum particle diameter (μm) in the channel.

The above particle diameters can be measured using MICROTRAC HRA9320-X100 (from Honewell). Measurement conditions may be as follows.

Measurement range: 8-100 μm

Channel width: 2 μm

The number of channels: 46

Index of refraction: 2.42

(Toner Production Method)

Exemplary methods of producing exemplary toners of the present invention are described below.

First, toner components are dissolved or dispersed in an organic solvent to prepare a toner components liquid. The toner components liquid is dispersed/emulsified in an aqueous medium including a surfactant and a particulate resin A having the same polarity as the surfactant and a volume average particle diameter of from 5 to 50 nm. A particulate resin B having a volume average particle diameter of from 10 to 500 nm is further added to the aqueous medium before the organic solvent is removed therefrom so that the particulate resin B is adhered to the surfaces of the resultant toner particles. When the toner components liquid is dispersed/emulsified in the aqueous medium, a dispersing agent is preferably added to the aqueous medium for the purpose of stabilizing droplets, forming the droplets into a desired shape, and narrowing particle diameter distribution of the droplets. Specific examples of usable dispersing agents include surfactants, poor-water-soluble inorganic dispersing agents, and polymer protection colloids, but are not limited thereto. These dispersing agents can be used alone or in combination. Among these dispersing agents, surfactants, especially anionic surfactants, are preferable.

(Particulate Resin A)

The particulate resin A may be a resin capable of forming an aqueous dispersion thereof. Specific examples of suitable resins for the particulate resin A include, but are not limited to, thermoplastic and thermosetting resins such as vinyl resins, polyurethane resins, epoxy resins, polyester resins, polyamide resins, polyimide resins, silicone reins, phenol resins, melamine resins, urea resins, aniline resins, ionomer resins, and polycarbonate resins. These resins can be used alone or in combination. Among these resins, vinyl resins, polyurethane resins, epoxy resins, and polyester resins are preferable because aqueous dispersions containing fine spherical particles thereof are easily obtained. Specific examples of the vinyl resins include homopolymers and polymers of vinyl monomers, such as styrene-(meth)acrylate copolymers, styrene-butadiene copolymers, (meth)acrylate-acrylate copolymers, styrene-acrylonitrile copolymers, styrene-maleic anhydride copolymers, and styrene-(meth) acrylic acid copolymers.

The particulate resin A is preferably anionic so as not to aggregate when used in combination with anionic surfactants. The particulate resin A can be prepared by using an anionic surfactant or introducing an anionic group such as carboxylic acid group and sulfonic acid group to a resin. The particulate resin A preferably has a primary volume average particle diameter of from 5 to 50 nm, more preferably from 10 to 25 nm, to control the particle diameters and the particle diameter distribution of droplets in the dispersion/emulsion. The primary volume average particle diameter of the particulate resin A can be measured using SEM, TEM, light scattering methods, and the like, and is preferably measured using a particle size distribution analyzer LA-920 (from Horiba, Ltd.).

The particulate resin A is preferably prepared as an aqueous dispersion thereof. Specific preferred methods for forming an aqueous dispersion of the particulate resin A include the following methods (1) to (8), for example.

(1) Subjecting a vinyl monomer to any one of suspension polymerization, emulsion polymerization, seed polymerization, and dispersion polymerization, so that an aqueous dispersion of a particulate resin is directly prepared.

(2) Dispersing a precursor (such as a monomer and an oligomer) of a polyaddition or polycondensation resin (such as a polyester resin, a polyurethane resin, and an epoxy resin) or a solvent solution thereof in an aqueous medium in the presence of a suitable dispersing agent, followed by heating or adding a curing agent, so that an aqueous dispersion of a particulate resin is prepared.

(3) Dissolving a suitable emulsifying agent in a precursor (such as a monomer and an oligomer) of a polyaddition or polycondensation resin (such as a polyester resin, a polyurethane resin, and an epoxy resin) or a solvent solution (preferably in liquid form, if not liquid, preferably liquefied by application of heat) thereof, and subsequently adding water thereto, so that an aqueous dispersion of a particulate resin is prepared by phase-inversion emulsification.

(4) Pulverizing a resin previously formed by a polymerization reaction (such as addition polymerization, ring-opening polymerization, polyaddition, addition condensation, condensation polymerization) using a mechanical rotational type pulverizer or a jet type pulverizer, classifying the pulverized particles to prepare a particulate resin, and dispersing the particulate resin in an aqueous medium in the presence of a suitable dispersing agent, so that an aqueous dispersion of the particulate resin is prepared.

(5) Spraying a resin solution, in which a resin previously formed by a polymerization reaction (such as addition polymerization, ring-opening polymerization, polyaddition, addition condensation, condensation polymerization) is dissolved in a solvent, into the air to prepare a particulate resin, and dispersing the particulate resin in an aqueous medium in the presence of a suitable dispersing agent, so that an aqueous dispersion of the particulate resin is prepared.

(6) Adding a poor solvent to a resin solution, in which a resin previously formed by a polymerization reaction (such as addition polymerization, ring-opening polymerization, polyaddition, addition condensation, condensation polymerization) is dissolved in a solvent, or cooling the resin solution which is previously dissolved in a solvent with application of heat, to precipitate a particulate resin, and dispersing the particulate resin in an aqueous medium in the presence of a suitable dispersing agent, so that an aqueous dispersion of the particulate resin is prepared.

(7) Dispersing a resin solution, in which a resin previously formed by a polymerization reaction (such as addition polymerization, ring-opening polymerization, polyaddition, addition condensation, condensation polymerization) is dissolved in a solvent, in an aqueous medium in the presence of a suitable dispersing agent, and removing the solvent by application of heat, reduction of pressure, and the like, so that an aqueous dispersion of a particulate resin is prepared.

(8) Dissolving a suitable emulsifying agent in a resin solution, in which a resin previously formed by a polymerization reaction (such as addition polymerization, ring-opening polymerization, polyaddition, addition condensation, condensation polymerization) is dissolved in a solvent, and subsequently adding water thereto, so that an aqueous dispersion of a particulate resin is prepared by phase-inversion emulsification.

(Particulate Resin B)

The particulate resin B may be prepared as the same methods as the particulate resin A. The particulate resin B preferably has a primary volume average particle diameter of from 10 to 500 nm, more preferably from 10 to 200 nm, to control the particle diameters and the particle diameter distribution of droplets of the toner components liquid in the dispersion/emulsion. The primary volume average particle diameter and particle diameter distribution of the particulate resin B can be measured as the same methods as the particulate resin A. In order to easily adhere the particulate resin B to the surfaces of droplets of the toner components liquid in the dispersion/emulsion, the particulate resin B is preferably capable of aggregating when mixed with the aqueous medium including an anionic surfactant. Such a particulate resin B can be prepared by using nonionic, amphoteric, or cationic surfactants or introducing a cationic group such as amine group and ammonium salt group into a resin.

Specific preferred examples of usable cationic surfactants include, but are not limited to, amine salt surfactants and quaternary ammonium salt surfactants. Specific examples of the amine salt surfactants include, but are not limited to, alkylamine salts, amino alcohol fatty acid derivatives, polyamine fatty acid derivatives, and imidazolines. Specific examples of the quaternary ammonium salt surfactants include, but are not limited to, alkyl trimethyl ammonium salts, dialkyl dimethyl ammonium salts, alkyl dimethyl benzyl ammonium salts, pyridinium salts, alkyl isoquinolinium salts, and benzethonium chlorides. Among these cationic surfactants, aliphatic primary, secondary, and tertiary amine acids having a fluoroalkyl group, aliphatic tertiary ammonium salts such as perfluoroalkyl(C6-C10)sulfonamide propyl trimethyl ammonium salts, benzalkonium salts, benzethonium chlorides, pyridinium salts, and imidazolinium salts are preferable.

Specific examples of usable commercially available cationic surfactants include, but are not limited to, SARFRON® S-121 (manufactured by Asahi Glass Co., Ltd.); FLUORAD® FC-135 (manufactured by Sumitomo 3M Ltd.); UNIDYNE® DS-202 (manufactured by Daikin Industries, Ltd.); MEGAFACE® F-150 and F-824 (manufactured by Dainippon Ink and Chemicals, Inc.); ECTOP® EF-132 (manufactured by Tohchem Products Co., Ltd.); and FUTARGENT® F-300 (manufactured by Neos).

Specific preferred examples of usable nonionic surfactants include, but are not limited to, fatty acid amide derivatives and polyvalent alcohol derivatives.

Specific preferred examples of usable amphoteric surfactants include, but are not limited to, alanine, dodecyl di(aminoethyl) glycine, di(octyl aminoethyl) glycine, and N-alkyl-N,N-dimethyl ammonium betaine.

The particulate resin B preferably includes a styrene-acrylic resin which is incompatible with the binder resin of the toner. Specific examples of usable styrene-acrylic resins include, but are not limited to, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, and styrene-acrylonitrile-indene copolymers. The particulate resin B may also include copolymers of styrene and other resins, such as styrene-p-chlorostyrene copolymers, styrene-propylene copolymers, styrene-vinyl toluene copolymers, styrene-vinyl naphthalene copolymers, styrene-vinyl methyl ketone copolymers, styrene-butadiene copolymers, styrene-isoprene copolymers, styrene-maleic acid copolymers, and styrene-maleate copolymers.

The particulate resin B is preferably prepared as an emulsion. The emulsion may be white and incompatible with the binder resin of the toner. The particulate resin B swells in organic solvents and the degree of the swelling depends on cross-linking density. The swelling property may be controllable by changing cross-linking density or the kinds of monomers. Since the kinds of monomers are usually changed for the purpose of controlling other properties, the swelling property is preferably controlled by changing cross-linking density.

The particulate resin B is preferably a cross-linked polymer so as to fix on the surfaces of droplets of the toner components liquid without dissolving therein. Such a cross-linked polymer is preferably a copolymer of monomers having at least 2 unsaturated groups. Specific examples of monomers having at least 2 unsaturated groups include, but are not limited to, a sodium salt of sulfate of ethylene oxide adduct of methacrylic acid (ELEMINOL RS-30 from Sanyo Chemical Industries, Ltd.), divinyl compounds such as divinylbenzene, and diacrylate compounds such as 1,6-hexanediol acrylate.

When the particulate resin B swells in organic solvents, the resultant toner provides reliable transfer efficiency and a wide fixable temperature range. In addition, the toner has an irregular shape and a smooth surface with an average circularity of from 0.950 to 0.970 and a BET specific surface area of from 0.2 to 4.0 $m^2/g$, which provides high cleanability. When the BET specific surface area is too small, cleanability may deteriorate. When the BET specific surface area is too large, reliability may deteriorate. If the degree of swelling of the particulate resin B is too large, the average circularity of the resultant toner may be too low. If the degree of swelling of the particulate resin B is too small, the BET specific surface area of the resultant toner may be too large, thereby decreasing transfer efficiency.

(Anionic Surfactants)

The anionic surfactants usable for exemplary toner production methods may be, for example, alkylbenzene sulfonates, α-olefin sulfonates, and phosphates. In particular, surfactants having a fluoroalkyl group are preferable. Specific preferred examples of anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl (C6-C11)oxy]-1-alkyl(C3-C4)sulfonic acid sodium, 3-[ω-fluoroalkanoyl(C6-C8)-N-ethylamino]-1-propane sulfonic acid sodium, fluoroalkyl(C11-C20)carboxylic acids and metal salts thereof, perfluoroalkyl(C7-C13)carboxylic acids and metal salts thereof, perfluoroalkyl(C4-C12)sulfonic acids and metal salts thereof, perfluorooctane sulfonic acid dimethanol amide, N-propyl-N-(2-hydroxyethyl)perfluorooctane sulfonamide, perfluoroalkyl(C6-C10)sulfonamide propyl trimethyl ammonium salts, perfluoroalkyl(C6-C10)-N-ethyl sulfonyl glycine salts, and monoperfluoroalkyl(C6-C16)ethyl phosphates.

Specific examples of usable commercially available anionic surfactants having a fluoroalkyl group include, but are not limited to, SARFRON® S-111, S-112 and S-113 (manufactured by Asahi Glass Co., Ltd.); FLUORAD® FC-93, FC-95, FC-98 and FC-129 (manufactured by Sumitomo 3M Ltd.); UNIDYNE® DS-101 and DS-102 (manufactured by Daikin Industries, Ltd.); MEGAFACE® F-110, F-120, F-113, F-191, F-812 and F-833 (manufactured by Dainippon Ink and Chemicals, Inc.); ECTOP® EF-102, 103, 104, 105, 112, 123A, 123B, 306A, 501, 201 and 204 (manufactured by Tochem Products Co., Ltd.); and FUTARGENT® F-100 and F-150 (manufactured by Neos).

(Binder Resin)

Specific examples of usable binder resins for exemplary toners include, but are not limited to, polyester-based resins, silicone resins, styrene-acrylic resins, styrene resins, acrylic resins, epoxy resins, diene resins, phenol resins, terpene resins, coumarin resins, amide imide resins, butyral resins, urethane resins, and ethylene-vinyl acetate resins.

Among these resins, polyester-based resins are preferable because of having sufficient flexibility even when the molecular weight is low. Such resins may quickly melt when being fixed on a recording medium and provide images with a smooth surface. Polyester-based resins may be used in combination with other resins.

An exemplary polyester-based resin may be formed from at least one polyol having the following formula (3) and at least one polycarboxylic acid having the following formula (4):

$$A\text{-}(OH)_m \quad (3)$$

wherein A represents an alkyl group having 1 to 20 carbon atoms, an alkylene group, an aromatic group which may have a substituent, or a heterocyclic aromatic group; and m represents an integer of from 2 to 4;

$$B\text{—}(OOOH)_n \quad (4)$$

wherein B represents an alkyl group having 1 to 20 carbon atoms, an alkylene group, an aromatic group which may have a substituent, or a heterocyclic aromatic group; and n represents an integer of from 2 to 4.

Specific examples of usable polyols having the formula (3) include, but are not limited to, ethylene glycol, diethylene glycol, triethylene glycol, 1,2-propylene glycol, 1,3-propylene-glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adducts of bisphenol A, propylene oxide adducts of bisphenol A, hydrogenated bisphenol A, ethylene oxide adducts of hydrogenated bisphenol A, and propylene oxide adducts of hydrogenated bisphenol A.

Specific examples of usable polycarboxylic acids having the formula (4) include, but are not limited to, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, cyclohexanedicarboxylic acid, cyclohexenedicarboxylic acid, butanetetracarboxylic acid, diphenylsulfonetetracarboxylic acid, and ethylene glycol bis(trimellitic acid).

In exemplary embodiments of the present invention, an unmodified binder resin and a precursor thereof (hereinafter "prepolymer") may be raw materials for the binder resin. Accordingly, the resultant binder resin may be a mixture of the unmodified resin and a resin that is a reaction product of the precursor. Within the context of the present specification, if the particulate resin B is stated to be incompatible with the binder resin, the particulate resin B may be incompatible with the unmodified resin.

(Compound Having Active Hydrogen Group)

The toner components may preferably include a compound having an active hydrogen group and a polymer reactive with the compound having an active hydrogen group. In this case, both the compound having an active hydrogen group and the polymer reactive with the compound having an active hydrogen group may be the precursor of a binder resin. The resultant toner may have high mechanical strength and burial of the particulate resin B and external additive may be prevented. When the compound having an active hydrogen group is cationic, the particulate resin B may be electrostatically attracted thereto advantageously. In addition, the resultant toner may have a wide fixable temperature range.

The compound having an active hydrogen group may function as an elongating agent and/or a cross-linking agent for elongating and/or cross-linking the polymer reactive with the compound having an active hydrogen group. For example, the polymer reactive with the compound having an active hydrogen group may be a polyester prepolymer (A) having an isocyanate group, and the compound having an active hydrogen group may be an amine (B). The amine (B) is capable of elongating and/or cross-linking the polyester prepolymer (A) to form a high-molecular-weight polymer.

The active hydrogen group may be, for example, an alcoholic hydroxyl group, a phenolic hydroxyl group, an amino group, a carboxylic group, or a mercapto group. The compound may include one or more of the above active hydrogen groups.

Specific examples of the amines (B) to be reacted with the polyester prepolymer (A) include, but are not limited to, diamines (B1), polyamines (B2) having 3 or more valences, amino alcohols (B3), amino mercaptans (B4), amino acids (B5), and blocked amines (B6) in which the amino groups in the amines (B1) to (B5) are blocked. These compounds can be used alone or in combination. Among these amines (B), a diamine (B1) alone and a mixture of a diamine (B1) with a small amount of a polyamine (B2) having 3 or more valences are preferable.

Specific examples of the diamines (B1) include, but are not limited to, aromatic diamines such as phenylene diamine, diethyltoluene diamine, and 4,4'-diamino diphenylmethane; alicyclic diamines such as 4,4'-diamino-3,3'-dimethyldicyclohexylmethane, diamine cyclohexane, and isophorone diamine; and aliphatic diamines such as ethylene diamine, tetramethylene diamine, and hexamethylene diamine.

Specific examples of the polyamines (B2) having 3 or more valences include, but are not limited to, diethylene triamine and triethylene tetramine.

Specific examples of the amino alcohols (B3) include, but are not limited to, ethanolamine and hydroxyethyl aniline.

Specific examples of the amino mercaptans (B4) include, but are not limited to, aminoethyl mercaptan and aminopropyl mercaptan.

Specific examples of the amino acids (B5) include, but are not limited to, amino propionic acid and amino caproic acid.

Specific examples of the blocked amines (B6) in which the amino groups in the amines (B1) to (B5) are blocked include, but are not limited to, ketimine compounds obtained from the amines (B1) to (B5) and ketones (e.g., acetone, methyl ethyl ketone, methyl isobutyl ketone) and oxazoline compounds.

To terminate an elongation reaction and/or a cross-linking reaction between the compound having an active hydrogen group and the polymer reactive with the compound, so as to control the molecular weight of the resultant resin, a reaction terminator may be used. Specific examples of usable reaction terminators include, but are not limited to, monoamines (e.g., diethylamine, dibutylamine, butylamine, laurylamine) and those which are blocked (e.g., ketimine compounds).

The equivalent ratio ([NCO]/[NHx]) of isocyanate groups in the polyester prepolymer (A) to amino groups in the amine (B) is preferably 1/3 to 3/1, more preferably 1/2 to 2/1, and much more preferably 1/1.5 to 1.5/1. When the equivalent ratio ([NCO]/[NHx]) is too small, low-temperature fixability of the resultant toner may be poor. When the equivalent ratio ([NCO]/[NHx]) is too large, hot offset resistance of the resultant toner may be poor because the resultant binder resin (an urea-modified polyester resin) may have a low molecular weight.

(Polymer Reactive with Compound Having Active Hydrogen Group)

The polymer (hereinafter "prepolymer") reactive with a compound having an active hydrogen group may be, for example, polyol resins, polyacrylic resins, polyester resins, epoxy resins, and derivative resins thereof. Among these resins, polyester resins are preferable because of exhibiting high fluidity and high transparency when melts. The above resins can be used alone or in combination.

The prepolymer has a site reactive with a compound having an active hydrogen group. The site may be, for example, an isocyanate group, an epoxy group, a carboxylic acid group, and an acid chloride group. The prepolymer may include one or more of the above groups. Among these groups, isocyanate groups are preferable. Preferably, the prepolymer may be a polyester resin including a urea-bond-forming group (hereinafter "RMPE"), because it is easy to control the molecular weight of the RMPE and the RMPE may provide a wide fixable temperature range without applying oil to a fixing member.

The urea-bond-forming group may be an isocyanate group, for example. When the urea-bond-forming group is an isocyanate group, the RMPE may be the polyester prepolymer (A) having an isocyanate group. The polyester prepolymer (A) having an isocyanate group may be a reaction product of a polyester having an active hydrogen group, which is a polycondensation product of a polyol (PO) with a polycarboxylic acid (PC), with a polyisocyanate (PIC), for example.

The polyol (PO) may be diols (DIO), polyols (TO) having 3 or more valences, and mixtures thereof, for example. These polyols can be used alone or in combination. Among these polyols, a diol (DIO) alone and a mixture of a diol (DIO) with a small amount of a polyol (TO) having 3 or more valences are preferable.

Specific examples of usable diols (DIO) include, but are not limited to, alkylene glycols, alkylene ether glycols, alicyclic diols, alkylene oxide adducts of alicyclic diols, bisphenols, and alkylene oxide adducts of bisphenols.

Specific examples of usable alkylene glycols include, but are not limited to, alkylene glycols having 2 to 12 carbon atoms such as ethylene glycol, 1,2-propylene glycol, 1,3-propylene glycol, 1,4-butanediol, and 1,6-hexanediol.

Specific examples of usable alkylene ether glycols include, but are not limited to, diethylene glycol, triethylene glycol, dipropylene glycol, polyethylene glycol, polypropylene glycol, and polytetramethylene ether glycol.

Specific examples of usable alicyclic diols include, but are not limited to, 1,4-cyclohexanedimethanol and hydrogenated bisphenol A.

Specific examples of usable alkylene oxide adducts of alicyclic diols include, but are not limited to, the above-described alicyclic diols to which an alkylene oxide such as ethylene oxide, propylene oxide, and butylene oxide is adducted.

Specific examples of usable bisphenols include, but are not limited to, bisphenol A, bisphenol F, and bisphenol S.

Specific examples of usable alkylene oxide adducts of bisphenols include, but are not limited to, the above-described bisphenols to which an alkylene oxide such as ethylene oxide, propylene oxide, and butylene oxide is adducted.

Among these compounds, alkylene glycols having 2 to 12 carbon atoms and alkylene oxide adducts of bisphenols are preferable, and combinations of alkylene oxide adducts of bisphenols with alkylene glycols having 2 to 12 carbon atoms are more preferable.

Specific examples of usable polyols (TO) having 3 or more valences include, but are not limited to, polyvalent aliphatic alcohols having 3 or more valences, polyphenols having 3 or more valences, and alkylene oxide adducts of polyphenols having 3 or more valences.

Specific examples of usable polyvalent aliphatic alcohols having 3 or more valences include, but are not limited to, glycerin, trimethylolethane, trimethylolpropane, pentaerythritol, and sorbitol.

Specific examples of usable polyphenols having 3 or more valences include, but are not limited to, trisphenol PA (from Honshu Chemical Industry Co., Ltd.), phenol novolac, and cresol novolac.

Specific examples of usable alkylene oxide adducts of polyphenols having 3 or more valences include, but are not limited to, the above-described polyphenols having 3 or more valences to which an alkylene oxide such as ethylene oxide, propylene oxide, and butylene oxide is adducted.

When a diol (DIO) and a polyol (TO) having 3 or more valences are mixed, the mixing ratio (DIO/TO) is preferably from 100/0.01 to 100/10, and more preferably from 100/0.01 to 100/1.

The polycarboxylic acid (PC) may be dicarboxylic acids (DIC), polycarboxylic acids (TC) having 3 or more valences, and mixtures thereof, for example. These polycarboxylic acids can be used alone or in combination. Among these polycarboxylic acids, a dicarboxylic acid (DIC) alone and a mixture of a dicarboxylic acid (DIC) with a small amount of a polycarboxylic acid (TC) having 3 or more valences are preferable.

Specific examples of usable dicarboxylic acids (DIC) include, but are not limited to, alkylene dicarboxylic acids, alkenylene dicarboxylic acids, and aromatic dicarboxylic acids.

Specific examples of usable alkylene dicarboxylic acids include, but are not limited to, succinic acid, adipic acid, and sebacic acid.

Specific examples of usable alkenylene dicarboxylic acids include, but are not limited to, alkenylene dicarboxylic acids having 4 to 20 carbon atoms such as maleic acid and fumaric acid.

Specific examples of usable aromatic dicarboxylic acids include, but are not limited to, aromatic dicarboxylic acids having 8 to 20 carbon atoms such as phthalic acid, isophthalic acid, terephthalic acid, and naphthalenedicarboxylic acid.

Among these compounds, alkenylene dicarboxylic acids having 4 to 20 carbon atoms and aromatic dicarboxylic acids having 8 to 20 carbon atoms are preferable.

Specific examples of usable polycarboxylic acids (TC) having 3 or more valences include, but are not limited to, aromatic polycarboxylic acids having 9 to 20 carbon atoms such as trimellitic acid and pyromellitic acid.

Further, acid anhydrides and lower alkyl esters (e.g., methyl ester, ethyl ester, isopropyl ester) of the above-described dicarboxylic acids (DIC), polycarboxylic acids (TC) having 3 or more valences, and mixtures thereof may be also used as the polycarboxylic acid (PC).

When a dicarboxylic acid (DIC) and a polycarboxylic acid (TC) having 3 or more valences are mixed, the mixing ratio (DIC/TC) is preferably from 100/0.01 to 100/10, and more preferably from 100/0.01 to 100/1.

The equivalent ratio ([OH]/[COOH]) of hydroxyl group [OH] of the polyol (PO) to carboxyl group [COOH] of the polycarboxylic acid (PC) is typically from 2/1 to 1/1, preferably from 1.5/1 to 1/1, and more preferably from 1.3/1 to 1.02/1.

The polyester prepolymer (A) having an isocyanate group preferably includes the polyol (PO) unit in an amount of from 0.5 to 40% by weight, more preferably from 1 to 30% by weight, and much more preferably from 2 to 20% by weight. When the amount is too small, hot offset resistance and storage stability of the resultant toner may be poor. When the amount is too large, low-temperature fixability of the resultant toner may be poor.

Specific examples of usable polyisocyanates (PIC) include, but are not limited to, aliphatic polyisocyanates, alicyclic polyisocyanates, aromatic diisocyanates, aromatic aliphatic diisocyanates, isocyanurates, and the above-described polyisocyanates blocked with phenol derivatives, oxime, caprolactam, etc.

Specific examples of usable aliphatic polyisocyanates include, but are not limited to, tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate, and tetramethylhexane diisocyanate.

Specific examples of usable alicyclic polyisocyanates include, but are not limited to, isophorone diisocyanate and cyclohexylmethane diisocyanate.

Specific examples of usable aromatic diisocyanates include, but are not limited to, tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenyl ether-4,4'-diisocyanate.

Specific examples of usable aromatic aliphatic diisocyanates include, but are not limited to, $\alpha,\alpha,\alpha',\alpha'$-tetramethylxylylene diisocyanate.

Specific examples of usable isocyanurates include, but are not limited to, tris-isocyanatoalkyl-isocyanurate and triisocyanatocycloalkyl-isocyanurate.

These compounds can be used alone or in combination.

The equivalent ratio ([NCO]/[OH]) of isocyanate group [NCO] in the polyisocyanate (PIC) to hydroxyl group [OH] in the polyester resin having an active hydrogen group is preferably from 5/1 to 1/1, more preferably from 4/1 to 1.2/1, and much more preferably from 3/1 to 1.5/1. When the equivalent ratio ([NCO]/[OH]) is too large, low-temperature fixability of the resultant toner may be poor. When the equivalent ratio ([NCO]/[OH]) is too small, hot offset resistance of the resultant toner may be poor.

The polyester prepolymer (A) having an isocyanate group preferably includes the polyisocyanate (PIC) unit in an amount of from 0.5 to 40% by weight, more preferably from 1 to 30% by weight, and much more preferably from 2 to 20% by weight. When the amount is too small, hot offset resistance and storage stability of the resultant toner may be poor. When the amount is too large, low-temperature fixability of the resultant toner may be poor.

The number of isocyanate groups included in one molecule of the polyester prepolymer (A) having an isocyanate group is preferably 1 or more, more preferably from 1.2 to 5, and much more preferably from 1.5 to 4. When the number of isocyanate groups is too small, the molecular weight of the prepolymer may be small and the resultant toner may have poor hot offset resistance.

The polymer reactive with a compound having an active hydrogen group preferably have a weight average molecular weight (Mw) of from 3,000 to 40,000, and more preferably from 4,000 to 30,000, when THF-soluble components thereof are subjected to a measurement of the molecular weight distribution by gel permeation chromatography (GPC). When the weight average molecular weight (Mw) is too small, hot offset resistance of the resultant toner may be poor. When the weight average molecular weight (Mw) is too large, low-temperature fixability of the resultant toner may be poor.

The molecular weight distribution of a resin can be measured as follows. In a GPC instrument, columns are stabilized in a heat chamber at 40° C. Tetrahydrofuran (THF) serving as a solvent is flown therein at a flow speed of 1 ml/min, and 50 to 200 μl of a 0.05 to 0.6% by weight tetrahydrofuran solution of the resin is injected therein. A molecular weight distribution of the resin is determined from a calibration curve created from at least 10 monodisperse polystyrene standard samples, availabe from Pressure Chamical Co., Tohso Corporation, etc., each having molecular weights of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$. As a detector, RI (refractive index) detectors are preferable.

Exemplary toners of the present invention may include other additives such as colorants, release agents, charge controlling agents, particulate inorganic materials, fluidity improving agents, cleanability improving agents, magnetic materials, metal salts, etc.

(Colorant)

Specific examples of usable colorants include, but are not limited to, dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These colorants can be used alone or in combination.

The toner preferably includes a colorant in an amount of from 1 to 15% by weight, and more preferably from 3 to 10% by weight. When the amount is too small, the resultant toner may have poor coloring power. When the amount is too large, the colorant may not be finely dispersed in the toner, resulting in deterioration of coloring power and electric properties.

The colorant can be combined with a resin to be used as a master batch. Specific examples of usable resins for master batches include, but are not limited to, polyesters, styrene and substituted styrene polymers, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyrals, polyacrylic acids, rosins, modified rosins, terpene resins, aliphatic and alicyclic hydrocarbon resins, aromatic petroleum resins, chlorinated paraffins, and paraffin waxes. These resins can be used alone or in combination.

Specific examples of usable styrene and substituted styrene polymers include, but are not limited to, polystyrene, poly-p-chlorostyrene, and polyvinyltoluene.

Specific examples of usable styrene copolymers include, but are not limited to, styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

The colorant may be arbitrarily included in either the binder resin of the toner or the particulate resin B because compatibility of the colorant with the binder resin and that with the particulate resin B are different. It is known that colorants may degrade charging properties of toner when present on the surface of the toner. Accordingly, when the colorant is selectively included in the binder resin that is present in an inner layer of the toner, charging properties of the toner such as environmental stability, charge holding ability, and charge quantity may improve.

(Release Agent)

Suitable release agents preferably have a low melting point of from 50 to 120° C. Such a release agent may be dispersed in the binder resin of the toner. The release agent may exude from the toner when the toner is fixed on a recording medium and facilitates separation of the toner from a fixing roller. Therefore, hot offset may not occur even when no oil is applied to the fixing roller.

Suitable release agents may be waxes, for example. Specific examples of usable waxes include, but are not limited to, natural waxes such as plant waxes (e.g., camauba wax, cotton wax, sumac wax, rice wax), animal waxes (e.g., beeswax, lanoline), mineral waxes (e.g., ozokerite, ceresin), and petroleum waxes (e.g., paraffin, microcrystalline, petrolatum); synthesized hydrocarbon waxes such as Fisher-Tropsch waxes and polyethylene waxes; synthesized waxes such as esters, ketones, and ethers; fatty acid amides such as 12-hydroxystearic acid amide, stearic acid amide, phthalic anhydride imide, and chlorinated hydrocarbon; low-molecular-weight crystalline polymers such as homopolymers or copolymers of polyacrylates such as poly-n-stearyl methacrylate and poly-n-lauryl methacrylate (e.g., n-stearyl acrylate-ethyl methacrylate copolymer); and crystalline polymers having a long side chain. These release agents can be used alone or in combination.

The release agent preferably has a melting point of from 50 to 120° C., and more preferably from 60 to 90° C. When the melting point is too low, storage stability of the resultant toner may be poor. When the melting point is too high, cold offset is likely to occur when the toner is fixed at a low temperature. The release agent preferably has a melt viscosity of from 5 to 1,000 cps, and more preferably from 10 to 100 cps, when measured at a temperature 20° C. higher than the melting point of the release agent. When the melt viscosity is too small, the resultant toner may have poor separability. When the melt viscosity is too large, hot offset resistance and low-temperature fixability of the resultant toner may be poor. The toner preferably includes the release agent in an amount of from 0 to 40% by weight, and more preferably from 3 to 30% by weight. When the amount is too large, the resultant toner may have poor fluidity.

The release agent may be arbitrarily included in either the binder resin of the toner or the particulate resin B because compatibility of the release agent with the binder resin and that with the particulate resin B are different. When the release agent is selectively included in the particulate resin B that is present in an outer layer of the toner, the release agent may exude from the toner easily when the toner is heated, even when the heating time is short. When the release agent is selectively included in the binder resin that is present in an inner layer of the toner, image forming members such as photoreceptors and carriers may be prevented from being contaminated with the release agent. The release agent may be flexibly arranged in the toner as appropriate according to image forming processes.

(Charge Controlling Agent)

Specific examples of usable charge controlling agents include, but are not limited to, Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and metal salts of salicylic acid derivatives. These charge controlling agents can be used alone or in combination.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, and azo pigments, and polymers having a functional group such as a sulfonate group, a carboxyl group, and a quaternary ammonium group.

The charge controlling agent may be arbitrarily included in either the binder resin of the toner or the particulate resin B because compatibility of the charge controlling agent with the binder resin and that with the particulate resin B are different. When the charge controlling agent is selectively included in the particulate resin B that is present in an outer layer of the toner, the toner may exhibit sufficient chargeability even when the amount of the charge controlling agent is small. When the charge controlling agent is selectively included in the binder resin that is present in an inner layer of the toner, image forming members such as photoreceptors and carriers may be prevented from being contaminated with the charge controlling agent. The charge controlling agent may be flexibly arranged in the toner as appropriate according to image forming processes.

The content of the charge controlling agent in the toner is determined depending on the species of the binder resin used, and toner manufacturing method (such as dispersion method) used, and is not particularly limited. However, the content of the charge controlling agent is prefrably from 0.1 to 10 parts by weight, and preferably from 0.2 to 5 parts by weight, per 100 parts by weight of the binder resin included in the toner. When the content is too high, the toner may have an excessively large charge quantity. Such a toner may be electrostatically attracted to a developing roller, which results in deterioration of fluidity of the toner and the resultant image density.

(Particulate Inorganic Materials)

Particulate inorganic materials may be externally added to the toner to improve fluidity, developability, and chargeability. Specific examples of usable particulate inorganic materials include, but are not limited to silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. These inorganic materials can be used alone or in combination.

The particulate inorganic materials may have a relatively large primary average particle diameter of from 80 to 500 nm. Alternatively, the particulate inorganic materials may have a relatively small primary average particle diameter of from 5 to 50 nm, and more preferably from 10 to 30 nm. The particulate inorganic material preferably has a BET specific surface area of from 20 to 500 $m^2/g$. The toner preferably includes both a large-size particulate inorganic material and a small-size particulate inorganic material each in an amount of from 0.01 to 5% by weight, more preferably from 0.01 to 2.0% by weight, based on total weight of the toner.

Silicas and titanium oxides may be treated with fluidity improving agents so as to improve hydrophobicity and to prevent deterioration of fluidity and chargeability of the resultant toners even in high humidity conditions. Specific examples of usable fluidity improving agents include, but are not limited to, silane-coupling agents, silylation agents, silane-coupling agents having a fluorinated alkyl group, silicone oils, and modified silicone oils. Hydrophobized silicas and hydrophobized titanium oxides are most preferable for the particulate inorganic material.

(Cleanability Improving Agent)

A cleanability improving agent may be added to the toner so that residual toner particles remaining on the surface of a photoreceptor or a primary transfer medium without being transferred onto a recording radium are easily removed. Specific examples of usable cleanability improving agents include, but are not limited to, metal salts of fatty acids such as zinc stearate and calcium stearate; and particulate polymers such as polymethyl methacrylate and polystyrene, which are produced by soap-free emulsion polymerization methods. Particulate polymers preferably have a relatively narrow particle diameter distribution and a volume average particle diameter of from 0.01 μm to 1 μm.

(Magnetic Material)

Specific examples of usable magnetic materials include, but are not limited to, iron powders, magnetites, and ferrites. In view of color tone of the resultant toner, whitish materials are preferable.

(Production Method of Toner)

As described above, exemplary toners of the present invention may be prepared as follows, for example. First, toner components including a colorant and a binder resin or a precursor thereof are dissolved or dispersed in an organic solvent to prepare a toner components liquid. The toner components liquid is dispersed/emulsified in an aqueous medium including a particulate resin A and a particulate resin B to prepare a dispersion/emulsion of the toner components liquid. In the dispersion/emulsion, the particulate resin B adheres to droplets of the toner components liquid. Preferably, the toner components liquid include a compound having an active hydrogen group and a polymer reactive with the compound having an active hydrogen group, and the compound having an active hydrogen group reacts with the polymer reactive with the compound having an active hydrogen group in the aqueous medium to form an adhesive base material.

The toner components liquid is prepared by dissolving or dispersing toner components in a solvent. Toner components generally include a colorant and a binder resin and/or a combination of a compound having an active hydrogen group and a polymer reactive with the compound having an active hydrogen group, and optionally include a release agent, a charge controlling agent, and the like. Preferably, the toner components liquid is prepared by dissolving or dispersing toner components in an organic solvent. The organic solvent is preferably removed when or after toner particles are formed.

Organic solvents having a boiling point of less than 150° C. are preferable for dissolving or dispersing toner components because such organic solvents are easily removed in succeeding processes. Specific examples of usable organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These organic solvents can be used alone or in combination. Among these organic solvents, ester solvents are preferable, and ethyl acetate is most preferable. The toner components liquid preferably includes the organic solvent in an amount of from 40 to 300 parts by weight, more preferably from 60 to 140 parts by weight, and much more preferably from 80 to 120 parts by weight, based on 100 parts by weight of the toner components. As described above, the toner components liquid may be prepared by dissolving or dispersing toner components such as a compound having an active hydrogen group, a polymer reactive with the compound having an active hydrogen group, an unmodified polyester resin, a release agent, a colorant, and a charge controlling agent, in an organic solvent. Toner components other than a compound having an active hydrogen group and a polymer reactive with the compound having an active hydrogen group may be added to the aqueous medium when the aqueous medium is prepared. Alternatively, they may be added to the aqueous medium when the toner components liquid is added to the aqueous medium.

The aqueous medium may be water, a water-miscible solvent, or a mixture thereof, for example. Preferably, the aqueous medium is water. Specific examples of usable water-miscible solvents include, but are not limited to, alcohols, dimethylformamide, tetrahydrofuran, cellosolves, and lower ketones. Specific examples of usable alcohols include, but are not limited to, methanol, isopropanol, and ethylene glycol. Specific examples of usable lower ketones include, but are not limited to, acetone and methyl ethyl ketone. These compounds can be used alone or in combination.

The particulate resin A may be dispersed in the aqueous medium in the presence of an anionic surfactant. The aqueous medium preferably includes the anionic surfactant and the particulate resin A each in an amount of from 0.5 to 10% by weight. Subsequently, the particulate resin B is further added to the aqueous medium. When the particulate resin B tends to aggregate with the anionic surfactant, the aqueous medium is preferably subjected to high-speed shearing before dispersion/emulsification of the toner components liquid.

It is preferable that the aqueous medium is agitated while the toner components liquid is dispersed/emulsified in the aqueous medium. The aqueous medium may be agitated by low-speed shearing-type disperser and high-speed shearing-type disperser, for example. In exemplary embodiments, a compound having an active hydrogen group and a polymer reactive with the compound having an active hydrogen group are subjected to elongation and/or cross-linking reactions when the toner components liquid is dispersed/emulsified in the aqueous medium, so that an adhesive base material is produced. The particulate resin B may be added to the aqueous medium when or after the dispersion/emulsification of the toner components liquid in the aqueous medium. Whether the particulate resin B is added while the aqueous medium is subjected to high-speed shearing during the dispersion/emulsification or low-speed agitation after the dispersion/emulsification may be determined depending on how the particulate resin B adheres to the toner.

The base adhesive material may be a reaction product of a compound having an active hydrogen group and a polymer reactive with the compound having an active hydrogen group. The base adhesive material may exhibit adhesiveness to recording media such as paper. The base adhesive material preferably has a weight average molecular weight of 3,000 or more, more preferably from 5,000 to 1,000,000, and much more preferably from 7,000 to 500,000. When the weight average molecular weight is too small, hot offset resistance of the resultant toner may be poor.

Binder resins of the toner preferably have a glass transition temperature (Tg) of from 30 to 70° C., and more preferably from 40 to 65° C. When Tg is too small, heat-resistant storage stability of the resultant toner may be poor. When Tg is too large, low-temperature fixability of the resultant toner may be poor. Because of including cross-linked and/or elongated polyester resins, exemplary toners of the present invention have better storage stability even if Tg of such polyester resins is lower compared to other polyester-based toners.

The glass transition temperature (Tg) can be measured using instruments TA-60WAS and DSC-60 both from Shimadzu Corporation under the following conditions.

Sample container: Aluminum sample pan with a lid

Sample quantity: 5 mg

Reference: Aluminum sample pan containing 10 mg of alumina

Atmosphere: Nitrogen (flow rate: 50 ml/min)

Temperature conditions:

Start temperature: 20° C.

Temperature rising rate: 10° C./min

End temperature: 150° C.

Retention time: none

Temperature decreasing rate: 10° C./min

End temperature: 20° C.

Retention time: none

Temperature rising rate: 10° C./min

End temperature: 150° C.

Measurement results can be analyzed using data analysis software TA-60 version 1.52 from Shimadzu Corporation. For example, in order to determine the glass transition temperature (Tg), first, a DrDSC curve is analyzed using a peak analysis function of the software, with specifying a range of ±5° C. around the lowest temperature at which a maximum peak is observed, to determine a peak temperature. The DrDSC curve is a differential curve of a DSC curve obtained in the second temperature rising scan. Next, the DSC curve is analyzed using the peak analysis function of the software, with specifying a range of ±5° C. around the peak temperature, to determine a maximum endothermic temperature. The maximum endothermic temperature thus obtained is defined as the glass transition temperature (Tg).

Specific preferred examples of usable binder resins include polyester-based resins, but are not limited thereto. Specific preferred examples of usable polyester-based resins include urea-modified polyester resins and unmodified polyester resins, but are not limited thereto. Urea-modified polyester resins may be formed by reacting an amine (B) serving as a compound having an active hydrogen with a polyester prepolymer (A) having an isocyanate group serving as a polymer reactive with the compound having an active hydrogen group. Urea-modified polyester resins may include urethane bonds besides urea bonds. In this case, the molar ratio of urea bonds to urethane bonds is preferably from 100/0 to 10/90, more preferably from 80/20 to 20/80, and much more preferably from 60/40 to 30/70. When the ratio is too small, hot offset resistance of the resultant toner may be poor.

Specific exemplary combinations of a urea-modified polyester resin and an unmodified polyester resin may include the followings:

(1) A mixture of an urea-modified polyester produced by reacting isophorone diamine with a polyester prepolymer produced by reacting isophorone diisocyanate with a polycondensation product of ethylene oxide 2 mol adduct of bisphenol A with isophthalic acid, and a polycondensation product of ethylene oxide 2 mol adduct of bisphenol A with isophthalic acid;

(2) A mixture of an urea-modified polyester produced by reacting isophorone diamine with a polyester prepolymer produced by reacting isophorone diisocyanate with a polycondensation product of ethylene oxide 2 mol adduct of bisphenol A with isophthalic acid, and a polycondensation product of ethylene oxide 2 mol adduct of bisphenol A with terephthalic acid;

(3) A mixture of an urea-modified polyester produced by reacting isophorone diamine with a polyester prepolymer produced by reacting isophorone diisocyanate with a polycondensation product of ethylene oxide 2 mol adduct of bisphenol A/propylene oxide 2 mol adduct of bisphenol A with isophthalic acid, and a polycondensation product of ethylene oxide 2 mol adduct of bisphenol A/propylene oxide 2 mol adduct of bisphenol A with terephthalic acid;

(4) A mixture of an urea-modified polyester produced by reacting isophorone diamine with a polyester prepolymer produced by reacting isophorone diisocyanate with a polycondensation product of ethylene oxide 2 mol adduct of bisphenol A/propylene oxide 2 mol adduct of bisphenol A with terephthalic acid, and a polycondensation product of ethylene oxide 2 mol adduct of bisphenol A with terephthalic acid;

(5) A mixture of an urea-modified polyester produced by reacting hexamethylene diamine with a polyester prepolymer produced by reacting isophorone diisocyanate with a polycondensation product of ethylene oxide 2 mol adduct of bisphenol A with terephthalic acid, and a polycondensation product of ethylene oxide 2 mol adduct of bisphenol A with terephthalic acid;

(6) A mixture of an urea-modified polyester produced by reacting hexamethylene diamine with a polyester prepolymer produced by reacting isophorone diisocyanate with a polycondensation product of ethylene oxide 2 mol adduct of bisphenol A with terephthalic acid, and a polycondensation product of ethylene oxide 2 mol adduct of bisphenol A/propylene oxide 2 mol adduct of bisphenol A with terephthalic acid;

(7) A mixture of an urea-modified polyester produced by reacting ethylene diamine with a polyester prepolymer produced by reacting isophorone diisocyanate with a polycondensation product of ethylene oxide 2 mol adduct of bisphenol A with terephthalic acid, and a polycondensation product of ethylene oxide 2 mol adduct of bisphenol A with terephthalic acid;

(8) A mixture of an urea-modified polyester produced by reacting hexamethylene diamine with a polyester prepolymer produced by reacting diphenylmethane diisocyanate with a polycondensation product of ethylene oxide 2 mol adduct of bisphenol A with isophthalic acid, and a polycondensation product of ethylene oxide 2 mol adduct of bisphenol A with isophthalic acid;

(9) A mixture of an urea-modified polyester produced by reacting hexamethylene diamine with a polyester prepolymer produced by reacting diphenylmethane diisocyanate with a polycondensation product of ethylene oxide 2 mol adduct of bisphenol A/propylene oxide 2 mol adduct of bisphenol A with terephthalic acid/dodecenylsuccinic anhydride, and a polycondensation product of ethylene oxide 2 mol adduct of bisphenol A/propylene oxide 2 mol adduct of bisphenol A with terephthalic acid; and

(10) A mixture of an urea-modified polyester produced by reacting hexamethylene diamine with a polyester prepolymer produced by reacting toluene diisocyanate with a polycondensation product of ethylene oxide 2 mol adduct of bisphenol A with isophthalic acid, and a polycondensation product of ethylene oxide 2 mol adduct of bisphenol A with isophthalic acid.

The urea-modified polyester resin may be formed by, for example:

(1) dispersing/emulsifying a toner components liquid including a polymer reactive with a compound having an active hydrogen group (such as a polyester prepolymer (A) having an isocyanate group) in an aqueous medium together with a compound having an active hydrogen group (such as an amine (B));

(2) dispersing/emulsifying the toner components liquid in an aqueous medium to which a compound having an active hydrogen group is previously added, to form droplets, and subject the polymer reactive with a compound having an active hydrogen group and the compound having an active hydrogen group to an elongation and/or cross-linking reaction therein; or (3) dispersing/emulsifying the toner components liquid in an aqueous medium first, and subsequently adding a compound having an active hydrogen group to the aqueous medium, to form droplets, and subject the polymer reactive with a compound having an active hydrogen group and the compound having an active hydrogen group to an elongation and/or cross-linking reaction at the surfaces of the droplets.

In the above case (3), a resultant modified polyester resin may be preferentially formed on the surfaces of the toner particles. The toner particles may have a concentration gradient of the modified polyester resin from the surface to the interior of each of the toner particles.

The reaction time of the polymer reactive with a compound having an active hydrogen group with the compound having an active hydrogen group is preferably from 10 minutes to 40 hours, and more preferably from 2 hours to 24 hours.

To reliably form a dispersion/emulsion containing a polymer reactive with a compound having an active hydrogen group (such as a polyester prepolymer (A) having an isocyanate group), first, a toner components liquid may be prepared by dissolving or dispersing the polymer reactive with a compound having an active hydrogen group (such as a polyester prepolymer (A) having an isocyanate group), a colorant, a release agent, a charge controlling agent, an unmodified polyester resin, etc., in an organic solvent. Next, the toner components liquid thus prepared may be added to an aqueous medium and dispersed therein by application of shearing force.

The usable amount of the aqueous medium at the dispersion/emulsification is preferably from 50 to 2,000 parts by weight, and more preferably from 100 to 1,000 parts by weight, based on 100 parts by weight of toner components. When the amount of the aqueous medium is too small, toner components may not be dispersed finely and the resultant particles may not have a desired size. When the amount of the aqueous medium is too large, toner production cost may increase.

The aqueous medium may further include an inorganic dispersing agent and/or a polymeric protection colloid other than the anionic surfactant and the particulate resin A aforementioned. Specific examples of usable inorganic dispersing agents include, but are not limited to, tricalcium phosphate, calcium carbonate, titanium oxide, colloidal silica, and hydroxyl apatite.

Specific examples of usable polymeric protection colloids include, but are not limited to, homopolymers and copolymers of monomers such as acid monomers, (meth)acrylic monomers having hydroxyl group, vinyl alcohols and ethers of vinyl alcohols, esters of vinyl alcohols with compounds having carboxyl group, amide compounds and methylol compounds thereof, acid chloride monomers, and monomers containing nitrogen or a heterocyclic ring containing nitrogen; polyoxyethylenes; and celluloses.

Specific examples of usable acid monomers include, but are not limited to, acrylic acid, methacrylic acid, α-cyanoacrylic acid, α-cyanomethacrylic acid, itaconic acid, crotonic acid, fumaric acid, maleic acid, and maleic anhydride.

Specific examples of usable (meth)acrylic monomers having hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, and N-methylol methacrylamide.

Specific examples of usable vinyl alcohols and ethers of vinyl alcohols include, but are not limited to, vinyl methyl ether, vinyl ethyl ether, and vinyl propyl ether.

Specific examples of usable esters of vinyl alcohols with compounds having carboxyl group include, but are not limited to, vinyl acetate, vinyl propionate, and vinyl butyrate.

Specific examples of usable amide compounds and methylol compounds thereof include, but are not limited to, acrylamide, methacrylamide, diacetone acrylamide, and methylol compounds thereof.

Specific examples of usable acid chloride monomers include, but are not limited to, acrylic acid chloride and methacrylic acid chloride.

Specific examples of usable monomers containing nitrogen or a heterocyclic ring containing nitrogen include, but are not limited to, vinyl pyridine, vinyl pyrrolidone, vinyl imidazole, and ethylene imine.

Specific examples of usable polyoxyethylenes include, but are not limited to, polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters, and polyoxyethylene nonylphenyl esters.

Specific examples of usable celluloses include, but are not limited to, methyl cellulose, hydroxyethyl cellulose, and hydroxypropyl cellulose.

Acid-soluble or alkaline-soluble dispersing agents such as calcium phosphate can be removed from the resultant particles by dissolving them by an acid such as hydrochloric acid, followed by washing with water. Alternatively, dispersing agents may be removed using enzymes.

The organic solvent may be removed from the dispersion/emulsion by, for example:

(1) gradually heating the dispersion/emulsion to completely evaporate the organic solvent from the droplets; or (2) spraying the dispersion/emulsion into dry atmosphere to completely remove the water-insoluble organic solvent from the droplets and form toner particles while removing aqueous dispersing agents.

Toner particles are generally formed upon removal of the organic solvent, followed by washing and drying, and optionally classification by size. The dispersion/emulsion may be subjected to a wet classification method such as cyclone, decantation, or centrifugal separation, to remove ultrafine particles. Alternatively, dried toner particles may be subjected to a dry classification method.

The toner particles thus prepared may be mixed with particulate materials such as colorants, release agents, charge controlling agents, etc., optionally upon application of mechanical impact thereto to fix the particulate materials on the toner particles. Specific examples of such mechanical impact application methods include a method in which a mixture is mixed with a highly rotated blade and a method in which a mixture is put into an air jet to collide the particles against each other or a collision plate. Specific examples of such mechanical impact applicators include, but are not limited to, ONG MILL (from Hosokawa Micron Co., Ltd.), modified I TYPE MILL in which the pressure of air used for pulverizing is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), and automatic mortars.

(Image Forming Method)

An exemplary image forming method of the present invention includes a charging process in which an electrophotographic photoreceptor (hereinafter simply "photoreceptor") is charged by a charger; an irradiating process in which the charged photoreceptor is irradiated by an irradiator to form an electrostatic latent image; a developing process in which the electrostatic latent image is developed by a developing device containing a toner to form a toner image; a primary transfer process in which the toner image is transferred from the photoreceptor onto an intermediate transfer member by a primary transfer device; a secondary transfer process in which the toner image is transferred from the intermediate transfer member onto a recording medium by a secondary transfer device; a fixing process in which the toner image is fixed on the recording medium by a fixing device including heat and pressure applying members; and a cleaning process in which residual toner particles remaining on the photoreceptor without being transferred onto the intermediate transfer member are removed by a cleaning device. The toner used in the developing process is an exemplary toner of the present invention aforementioned. The linear speed (i.e., printing speed) in the secondary transfer process, in which a toner image is transferred onto a recording medium, is preferably from 100 to 1,000 mm/sec, and the transfer time for transferring the toner image onto a recording medium at the secondary transfer nip is preferably from 0.5 to 60 msec.

Figure 2:
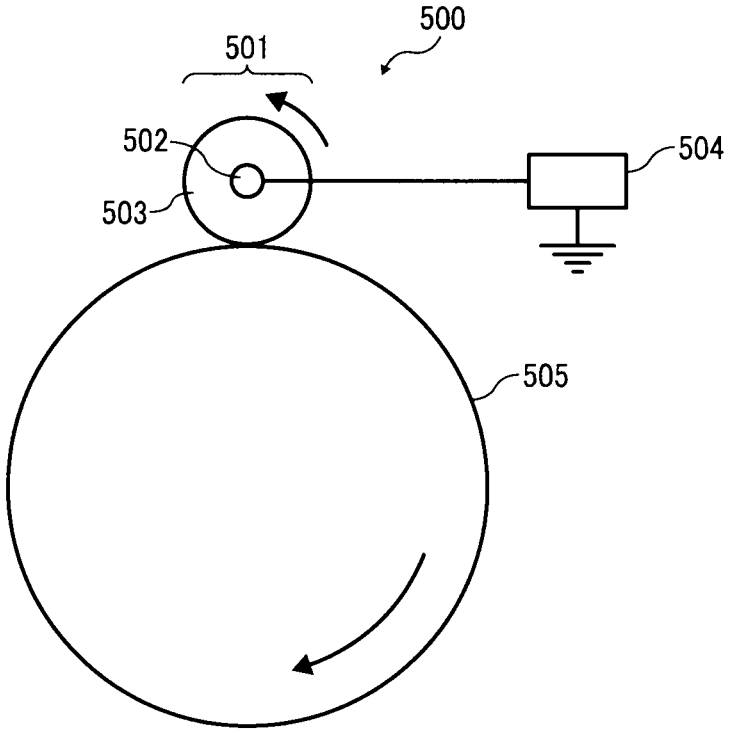
FIG. 2 is a schematic view illustrating an exemplary embodiment of a roller-type charger.
Figure 3:
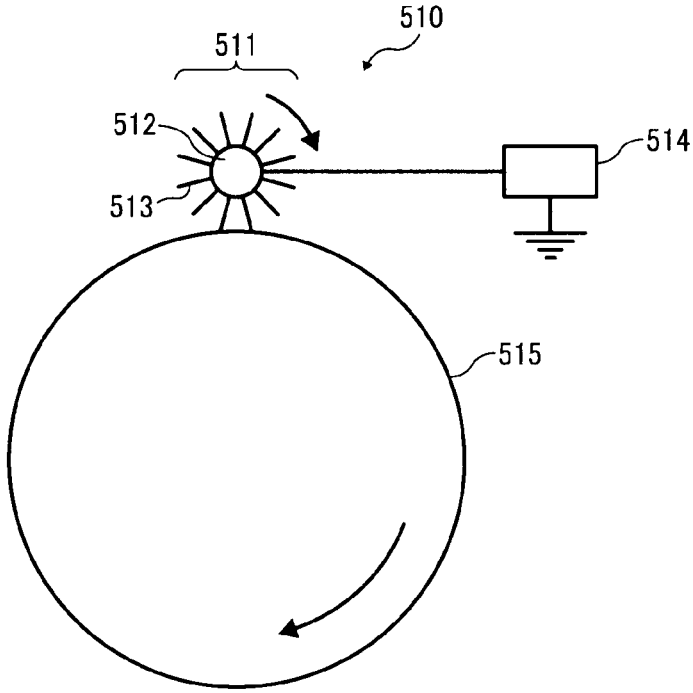
FIG. 3 is a schematic view illustrating an exemplary embodiment of a brush-type charger.

FIGS. 2 and 3 are schematic views illustrating exemplary embodiments of contact chargers.

FIG. 2 is a schematic view illustrating an exemplary embodiment of a roller-type charger 500, which is one of the contact chargers. A photoreceptor 505 serving as an image bearing member is a charging target, and is driven to rotate in a direction indicated by an arrow in FIG. 2 at a predetermined speed. A charging roller 501 serving as a charging member is in contact with the photoreceptor 505. The charging roller 501 includes a cored bar 502 and a conductive rubber layer 503 concentrically formed on an outer surface of the cored bar 502. Both ends of the cored bar 502 are rotatably supported by bearings, not shown. The charging roller 501 is pressed against the photoreceptor 505 at a predetermined pressure by a pressing unit, not shown. The charging roller 501 is driven to rotate by rotation of the photoreceptor 505. In the present embodiment, the cored bar 502 has a diameter of 9 mm and the conductive rubber layer 503 having a medium resistivity of 100,000 Ω·cm is formed thereon. The resultant charging roller 501 has a diameter of 16 mm. The cored bar 502 is electrically connected to a power source 504 so that a predetermined bias is applied to the charging roller 501 from the power source 504. Therefore, a circumferential surface of the photoreceptor 505 is charged to a predetermined potential with a predetermined polarity.

In addition to roller-type chargers as described above, brush-type chargers such as magnetic-brush-type chargers and fur-brush-type chargers may be used. An exemplary magnetic-brush-type charger may include ferrites such as Zn—Cu ferrite serving as a charging member, a non-magnetic conductive sleeve for supporting the charging member, and a magnet roll fixed inside the non-magnetic conductive sleeve. An exemplary fur-brush-type charger may include a fur which is treated with carbon, copper sulfide, a metal, or a metal oxide to have conductivity. The fur may be wound around or attached to a metal or a conductive cored bar.

FIG. 3 is a schematic view illustrating an exemplary embodiment of a brush-type charger 510, which is one of the contact chargers. A photoreceptor 515 serving as an image bearing member is a charging target, and is driven to rotate in a direction indicated by an arrow in FIG. 3 at a predetermined speed. A fur brush roller 511 is pressed against the photoreceptor 515 at a predetermined pressure to form a predetermined nip therebetween, while opposing elasticity of a brush part 513.

In the present embodiment, the fur brush roller 511 includes a cored bar 512, also serving as an electrode, having a diameter of 6 mm and a brush part 513. The brush part 513 includes a roll brush around which a pile fabric tape of a conductive rayon fiber REC-B (from Unitika, Ltd.) is spirally wound, and has an outer diameter of 14 mm and a longitudinal length of 250 mm. The brush part 513 includes 155 bristles per 1 $mm^2$ with 300 denir/50 filaments. The roll brush has been concentrically inserted in a pipe having an inner diameter of 12 mm while rotating in one direction and left in a high-temperature and high-humidity condition so that the bristles are bent.

In the present embodiment, the fur brush roller 511 has a resistance of $1\times10^5\Omega$ when a voltage of 100 V is applied thereto. The resistance is calculated from a current that flows when the fur brush roller is brought into contact with a metallic drum having a diameter of 30 mm forming a nip having a width of 3 mm therebetween, while a voltage of 100 V is applied thereto. In a case in which a defect, such as a pin hole, is made on the photoreceptor 515 due to low resistance to pressure, a leakage current may flow into the defect and cause insufficient charging at the charging nip. Therefore, the fur brush roller 511 preferably has a resistance of $1\times10^4\Omega$ or more to prevent such insufficient charging, which may cause image defect. To sufficiently inject charges to the surface of the photoreceptor 515, the fur brush roller 511 preferably has a resistance of $1\times10^7\Omega$ or less.

Commercially available materials usable for the brush include, but are not limited to, REC-C, REC-M1, and REC-M10 (from Unitika, Ltd.); SA-7 (from Toray Industries, Inc.); Thunderon® (from Nihon Sanmo Dyeing Co., Ltd.); Belltron® (from KB Seiren, Ltd.): Clacarbo® (from Kuraray Co., Ltd.); and rayon in which carbon is dispersed. A bristle is preferably from 3 to 10 deniers, and the brush preferably includes 10 to 100 filaments per bundle and 80 to 600 bristles per 1 $mm^2$. The thickness of the brush is preferably from 1 to 10 mm.

The fur brush roller 511 is driven to rotate at a predetermined peripheral speed so as to face rotation of the photoreceptor 515. The fur brush roller 511 is in contact with the photoreceptor 515 with a speed difference. A predetermined voltage is applied to the brush roller 511 from a power source 514 so that a surface of the photoreceptor 515 is uniformly charged to a predetermined potential with a predetermined polarity.

When the fur brush roller 511 charges the photoreceptor 515, direct charge injection occurs dominantly. Accordingly, a surface of the photoreceptor 515 is charged to substantially the same potential to the applied voltage.

As described above, exemplary embodiments of brush-type chargers further include magnetic-brush-type chargers. An exemplary magnetic-brush-type charger may include ferrites such as Zn—Cu ferrite serving as a charging member, a non-magnetic conductive sleeve for supporting the charging member, and a magnet roll fixed inside the non-magnetic conductive sleeve.

For example, the magnetic brush may include magnetic particles coated with a medium-resistance resin. The magnetic particles may be a mixture of particles of a Zn—Cu ferrite having an average diameter of 25 μm and particles of another Zn-Cu ferrite having an average diameter of 10 μm at a weight ratio of 1:0.05. Such magnetic particles may be formed into a layer with a thickness of 1 mm on the non-magnetic conductive sleeve, while forming a charging nip of about 5 mm with a photoreceptor. The distance between the sleeve and the photoreceptor may be about 500 μm. The magnet roll may be rotated so that the surface of the sleeve rotates in the opposite direction to rotation of the surface of the photoreceptor at double the peripheral speed of the photoreceptor, while contacting the photoreceptor. Accordingly, the magnetic brush may evenly contact the photoreceptor.

Figure 4:
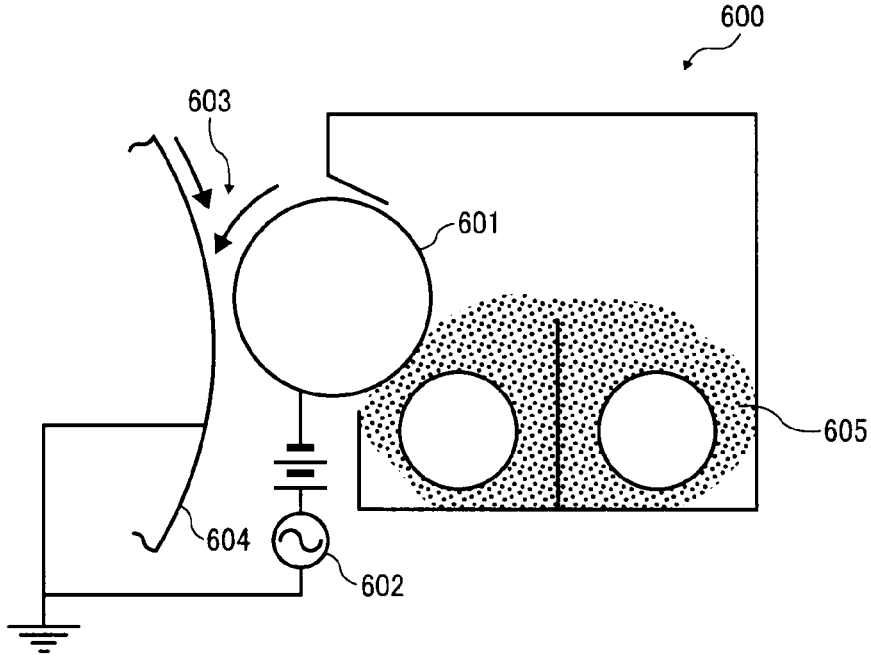
FIG. 4 is a schematic view illustrating an exemplary embodiment of a developing device.

In the developing process, a latent image formed on a photoreceptor is preferably developed upon application of alternating electric field. FIG. 4 is a schematic view illustrating an exemplary embodiment of a developing device 600. When a latent image is developed, a developing bias is applied to a developing sleeve 601 from a power source 602. The developing bias is a vibrating bias voltage in which an alternating current voltage is overlapped with a direct current voltage. Potentials of background area and image area are between the maximum and minimum values of the vibrating bias voltage. Therefore, an alternating electric field, in which the direction changes alternately, is formed in a developing area 603. Toner particles and carrier particles in a developer frenziedly vibrate in the alternating electric field. A toner 605 flies to a photoreceptor 604 and adheres to a latent image formed thereon while escaping from electrostatic binding forces to the developing sleeve 601 and the carrier particles. The toner 605 is an exemplary toner of the present invention described above.

The difference between the maximum and minimum values of the vibrating bias voltage (i.e., the voltage between peaks) is preferably from 0.5 to 5 kV. The frequency is preferably from 1 to 10 kHz. The waveform of the vibrating bias voltage may be square waves, sine waves, and triangular waves, for example. The direct current voltage component of the vibrating bias voltage is between background area potential and image area potential, and preferably closer to the background area potential rather than the image area potential. In this case, toner particles are unlikely to adhere to the background area.

When the vibrating bias voltage has a square waveform, a duty rate is preferably 50% or less. Here, the duty rate is a time rate during which a toner heads for a photoreceptor in one cycle of the vibration. When the duty rate is within the above range, the difference between a peak bias voltage, which is observed when a toner heads for a photoreceptor, and a time-average bias voltage may be large. Accordingly, toner particles may be more energized and adhere to a latent image more faithfully corresponding to electric potential distribution, improving definition and granularity of the resultant image. By contrast, with regard to carrier having the opposite polarity to toner, the difference between a peak bias voltage, which is observed when a carrier heads for a photoreceptor, and a time-average bias voltage may be small. Accordingly, carrier particles may be calmed and much less carrier particles may adhere to background area of a latent image advantageously.

Figure 5:
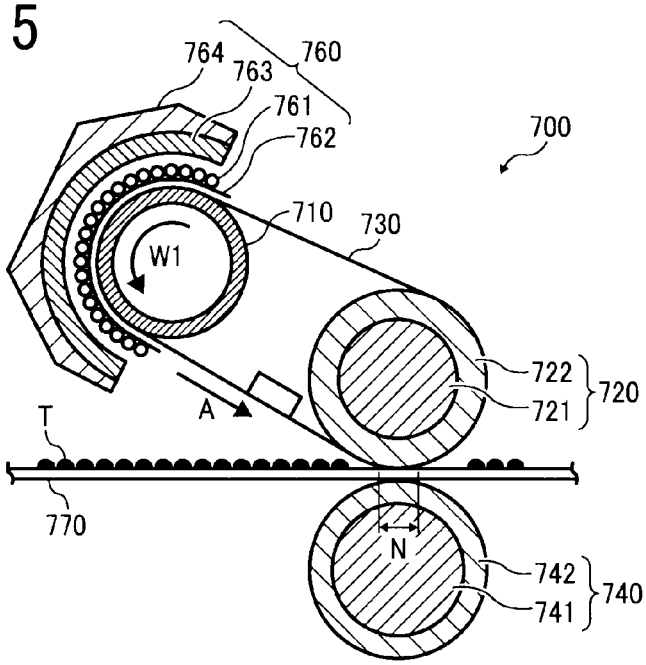
FIG. 5 is a schematic view illustrating an exemplary embodiment of a fixing device.

FIG. 5 is a schematic view illustrating an exemplary embodiment of a fixing device 700. The fixing device 700 includes a heating roller 710, a fixing roller 720, a fixing belt 730 serving as a toner heating member, and a pressing roller 740. The heating roller 710 is heated by an induction heater 760. The fixing roller 720 is provided in parallel with the heating roller 710. The fixing belt 730 is an endless heat-resistant belt which is stretched taut by the heating roller 710 and the fixing roller 720. The fixing belt 730 is heated by the heating roller 710. The fixing belt 730 is rotated in a direction indicated by an arrow A in FIG. 5 by rotation of at least one of the heating roller 710 and the fixing roller 720. The pressing roller 740 is pressed against the fixing roller 720 with the fixing belt 730 therebetween. The pressing roller 740 rotates in the forward direction relative to rotation of the fixing belt 730.

The heating roller 710 includes a magnetic metallic cylinder made of a material such as iron, cobalt, nickel, and alloys thereof, for example. The heating roller 710 may have an outer diameter of from 20 to 40 mm and a thickness of from 0.3 to 1.0 mm. The heating roller 710 has a low heat capacity so as to be heated quickly.

The fixing roller 720 includes a cored bar 721 and an elastic member 722 that covers the cored bar 721. The cored bar 721 may be made of a metal such as stainless steel. The elastic member 722 may be a solid or foamed heat-resistant silicon rubber. The fixing roller 720 may have an outer diameter of from 20 to 40 mm, which is greater than that of the heating roller 710. The pressing roller 740 is pressed against the fixing roller 720 so that a fixing nip N having a predetermined width is formed therebetween. The elastic member 722 may have a thickness of from 4 to 6 mm. Since the heating roller 710 has a lower heat capacity than the fixing roller 720, the heating roller 710 is heated quickly, resulting in shortening of warm-up period.

The fixing belt 730 is stretched taut by the heating roller 710 and the fixing roller 720. The induction heater 760 heats the heating roller 710, and the heating roller 710 heats the fixing belt 730 at a contact part W1. The inner surface of the fixing belt 730 is continuously heated owing to rotations of the heating roller 710 and the fixing roller 720. Consequently, the whole of the fixing belt 613 is heated.

Figure 6:
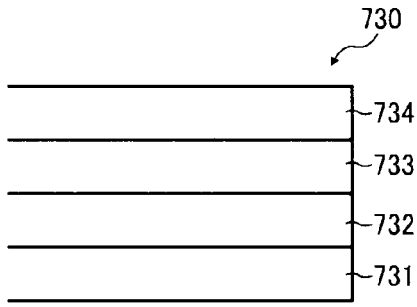
FIG. 6 is a cross-sectional schematic view illustrating an exemplary embodiment of a fixing belt included in the fixing device illustrated in FIG. 5.

FIG. 6 is a cross-sectional schematic view illustrating an exemplary embodiment of the fixing belt 730. The fixing belt 730 includes, in order form an innermost side thereof, a base layer 731 including a resin such as polyimide (PI), a heat generating layer 732 including a conductive material such as Ni, Ag, and SUS, an intermediate layer 733 including an elastic material, and a release layer 734 including a resin such as fluorocarbon resins.

The release layer 734 preferably has a thickness of from 10 to 300 μm, and more preferably about 200 μm. Referring to FIG. 5, a surface of the fixing belt 730 covers a toner image T formed on a recording medium 770 and heats and melts the toner image T to fix it on the recording medium 770. When the thickness is too small, abrasion resistance may deteriorate with time. When the thickness is too large, the fixing belt 730 may have a large heat capacity and therefore warm-up period may be long. Moreover, the surface temperature of the fixing belt 730 may be unlikely to decrease. Therefore, some melted toner particles in the toner image T may disadvantageously adhere to the fixing belt 730. (This phenomenon is so-called "hot offset".) The base layer 731 may include heat-resistant resins such as fluorocarbon resin, polyimide resins, polyamide resins, polyamideimide resins, PEEK resins, PES resins, and PPS resins. Alternatively, the heat generating layer 732 may also serve as a base layer.

The pressing roller 740 includes a cored bar 741 and an elastic member 742 provided on the surface of the cored bar 741. The cored bar 741 includes a metallic cylinder made of a metal having high heat conductivity such as copper, aluminum, and SUS, for example. The elastic member 742 has high heat resistance and high toner releasability. The pressing roller 740 and the fixing roller 720 form the fixing nip N with the fixing belt 730 therebetween. In the present embodiment, the pressing roller 740 has a greater hardness than the fixing roller 720 so that the pressing roller 740 bites into the fixing roller 720 (and the fixing belt 730). As a result, the recording medium 770 curves along the circumference of the pressing roller 740, which makes the recording medium 770 easily release from the surface of the fixing belt 730. The pressing roller 740 may have an outer diameter of from 20 to 40 mm, which is as the same as the fixing roller 720. The elastic member 742 may have a thickness of from 0.5 to 2.0 mm, which is thinner than the elastic member 722 of the fixing roller 720.

The induction heater 760 includes an exiting coil 761 serving as a magnetic field generator and a coil guide plate 762 around which the exiting coil 761 is wound. The coil guide plate 762 has a half-round shape and is provided adjacent to an outer circumference of the heating roller 710. The exciting coil 761 includes a long exiting coil wire that is alternately wound around the coil guide plate 762 in an axial direction of the heating roller 710. The exciting coil 761 is connected to a driving power source which includes a frequency-variable oscillation circuit, not shown. An exciting coil core 763 having a half-round shape is provided on the outer side of the exciting coil 761. The exciting coil core 763 includes a ferromagnet such as ferrite. The exciting coil 763 is fixed on an exciting coil core support member 764 and provided adjacent to the exciting coil 761.

(Process Cartridge)

An exemplary process cartridge of the present invention integrally supports a photoreceptor and a developing device for developing an electrostatic latent image formed on the photoreceptor with a toner to form a toner image. The process cartridge may be detachably mounted on image forming apparatuses. The developing device includes an exemplary toner of the present invention.

Figure 7:
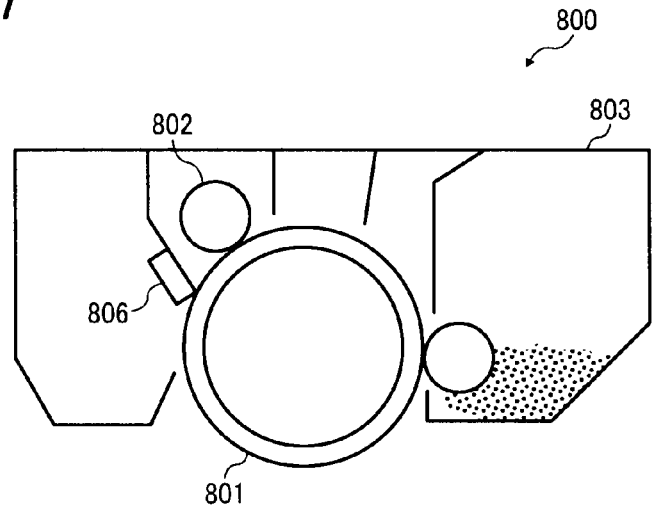
FIG. 7 is a schematic view illustrating an exemplary embodiment of a process cartridge.

FIG. 7 is a schematic view illustrating an exemplary embodiment of a process cartridge 800. The process cartridge 800 includes a photoreceptor 801, a charger 802, a developing device 803, and a cleaning device 806. The photoreceptor 801 is driven to rotate at a predetermined peripheral speed. A peripheral surface of the photoreceptor 801 is uniformly charged to a predetermined positive or negative potential by the charger 802 while rotating. Subsequently, the peripheral surface of the photoreceptor 801 is exposed to a laser light beam emitted from an irradiator such as a slit irradiator and a laser beam scanning irradiator, not shown, to form an electrostatic latent image thereon. The developing device 802 develops the electrostatic latent image with a toner to form a toner image. The toner image is then transferred onto a recording medium that is fed from a paper feed part, not shown, in synchronization with an entry of the toner image to a transfer nip formed between the photoreceptor 801 and a transfer device, not shown. The recording medium having the toner image thereon separates from the surface of the photoreceptor 801 and is introduced to a fixing device, not shown, to fix the toner image on the recording medium. The recording medium on which the toner image is fixed is discharged from the apparatus. Residual toner particles remaining on the surface of the photoreceptor 801 without being transferred are removed by the cleaning device 806. The surface of the photoreceptor 801 thus cleaned is then neutralized to prepare foe the next image formation.

(Image Forming Apparatus)

Figure 8:
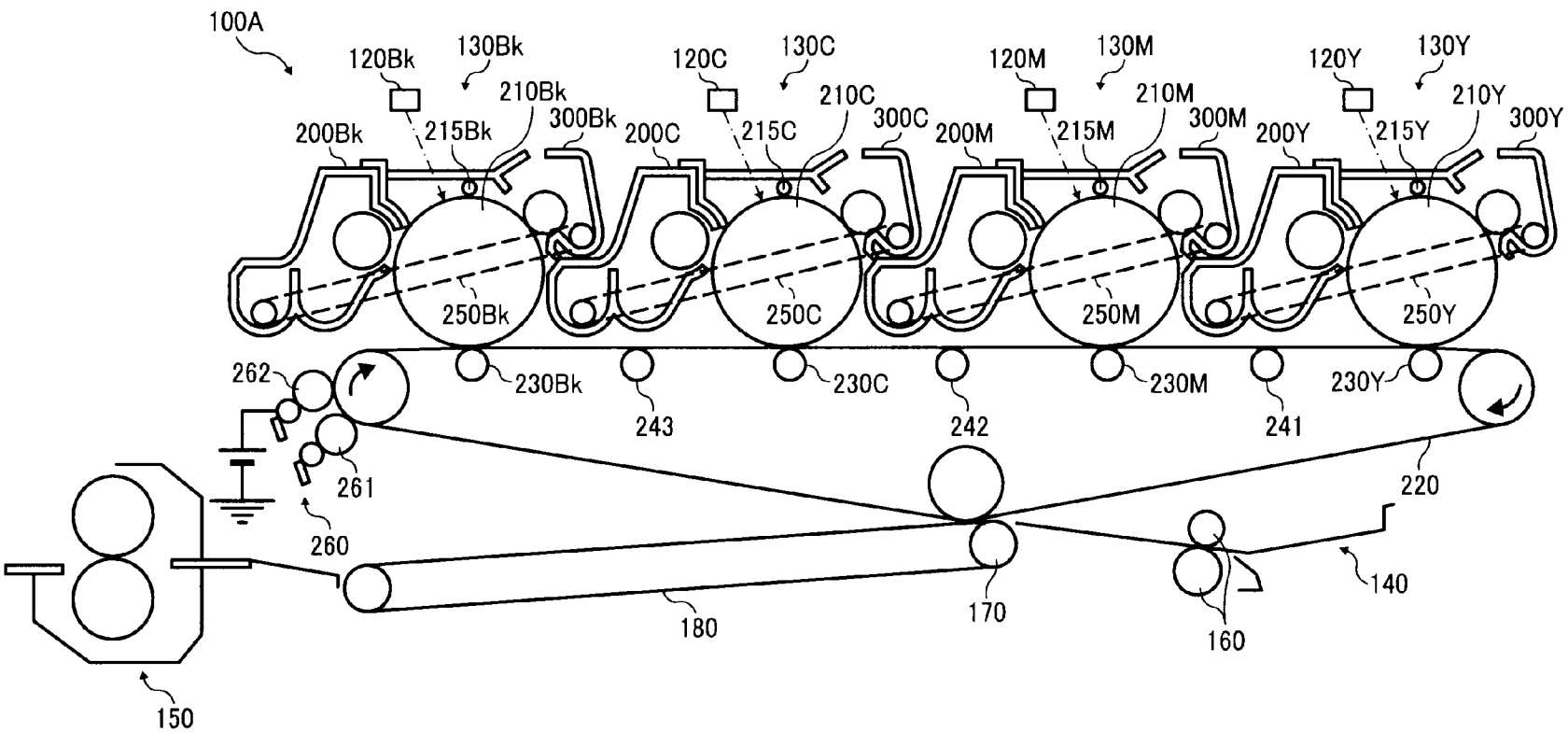
FIGS. 8 and 9 are schematic views illustrating exemplary embodiments of full-color tandem image forming apparatuses.
Figure 9:
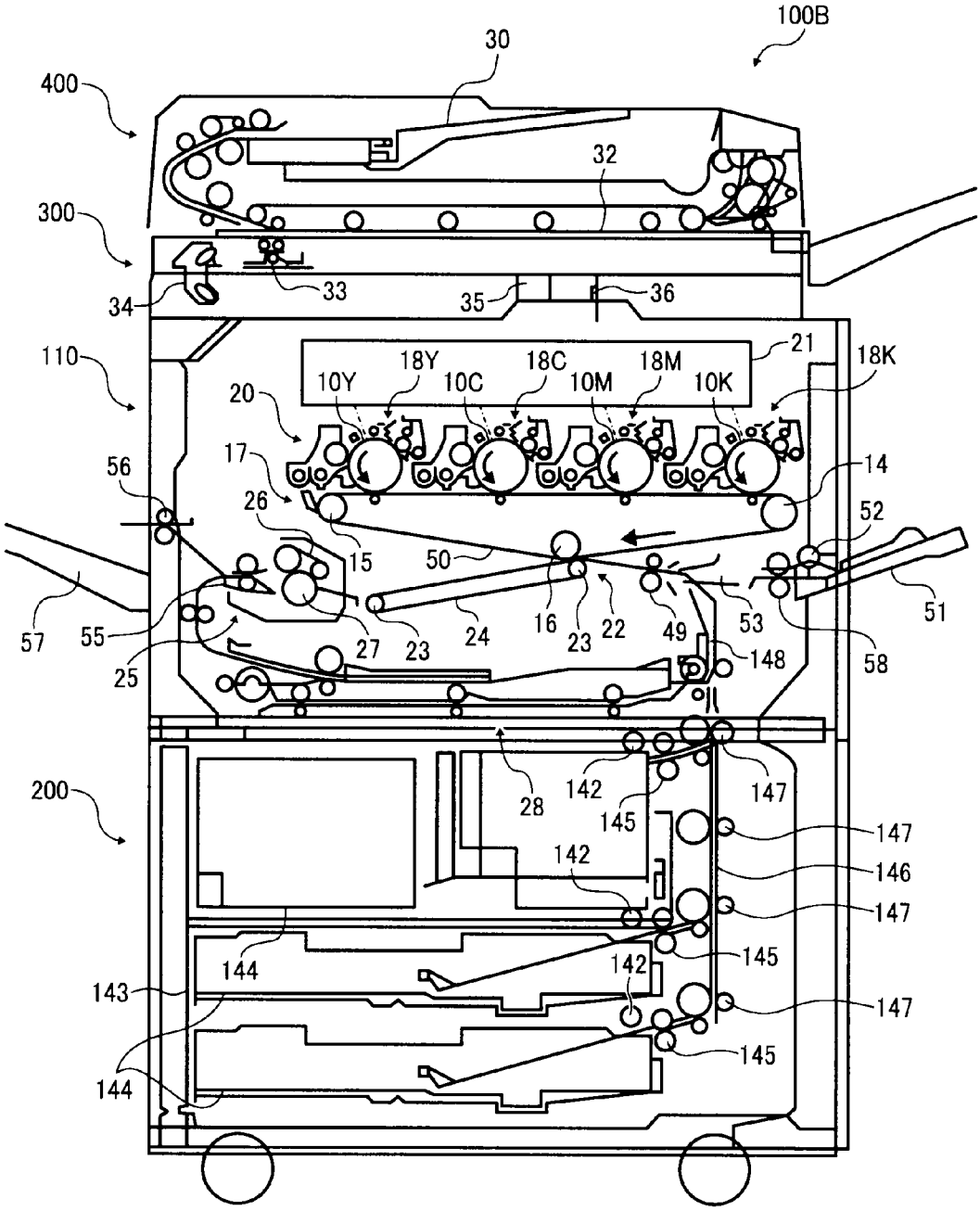

FIGS. 8 and 9 are schematic views illustrating exemplary embodiments of full-color tandem image forming apparatuses 100A and 100B, respectively.

Referring to FIG. 8, the image forming apparatus 100A includes image writing units 120Bk, 120C, 120M, and 120Y; image forming units 130Bk, 130C, 130M, and 130Y; and a paper feed part 140. An image processing part, not shown, converts an image signal into color signals of black, cyan, magenta, and yellow, and transmits the color signals to the image writing units 120Bk, 120C, 120M, and 120Y, respectively. Each of the image writing units 120Bk, 120C, 120M, and 120Y may be a laser light source, a deflector such as a rotating polygon mirror, or an optical system or mirrors for scanning imaging, for example. Each of the image writing units 120Bk, 120C, 120M, and 120Y has a writing optical path corresponding to color signals of black, cyan, magenta, and yellow, respectively, and writes an image on photoreceptors 210Bk, 210C, 210M, and 210Y, respectively.

The image forming units 130Bk, 130C, 130M, and 130Y include the photoreceptors 210Bk, 210C, 210M, and 210Y, respectively. The photoreceptors may be organic photoconductors. Around the photoreceptors 210Bk, 210C, 210M, and 210Y, chargers 215Bk, 215C, 215M, and 215Y, developing devices 200Bk, 200C, 200M, and 200Y, primary transfer devices 230Bk, 230C, 230M, and 230Y, cleaning devices 300Bk, 300C, 300M, and 300Y, and neutralization devices, not shown, are provided, respectively. In the present embodiment, the developing devices 200Bk, 200C, 200M, and 200Y employ a two-component magnetic brush developing method. An intermediate transfer belt 220 is provided between the developing devices 200Bk, 200C, 200M, and 200Y and the primary transfer devices 230Bk, 230C, 230M, and 230Y. Each color toner images are successively transferred from the photoreceptors 210Bk, 210C, 210M, and 210Y and superimposed on the intermediate transfer belt 220.

It is preferable that a pre-transfer charger is provided on the outer side of the intermediate transfer belt 220, on a downstream side from a primary transfer area (formed between the photoreceptor 210 and the primary transfer device 230) of the fourth color (i.e., yellow in the present embodiment) and an upstream side from a secondary transfer area (formed between the intermediate transfer belt 220 and a secondary transfer roller 170) relative to the direction of movement of the intermediate transfer belt 220. The pre-transfer charger is configured to uniformly charge all the toner particles which have been transferred from the photoreceptors 210 onto the intermediate transfer belt 220 to the same polarity before the toner image is transferred onto a recording medium.

Since toner images transferred from the photoreceptors 210Bk, 210C, 210M, and 210Y onto the intermediate transfer belt 220 may include various types of images such as half-tone image and solid image, there may be variations in the amount of toner and charge among the toner images. In some cases, electric discharge may occur at an airspace formed on a downstream side from the primary transfer area relative to the direction of movement of the intermediate transfer belt 220, and charge variations may be generated in a single toner image which has been transferred onto the intermediate transfer belt 220. In such a case, the toner image may not be reliably transferred onto a recording medium in the secondary transfer area. The pre-transfer charger may uniformly charges all the toner particles to the same polarity before the toner image is transferred onto a recording medium. Accordingly, charge variations in a single toner image may be eliminated and the secondary transfer may be reliably performed.

By uniformly charging toner images which have been transferred from the photoreceptors 210Bk, 210C, 210M, and 210Y onto the intermediate transfer belt 220 by the pre-transfer charger, the whole toner images may be reliably and uniformly transferred onto a recording medium in the secondary transfer area even when there are charge variations in a single toner image.

The pre-transfer charger charges a toner image depending on the moving speed of the intermediate transfer belt 220. Specifically, the smaller the moving speed of the intermediate transfer belt 220, the larger the charge amount of the toner image, because the toner image pass through the charging area over a longer period of time. By contrast, the larger the moving speed of the intermediate transfer belt 220, the smaller the charge amount of the toner image, because the toner image pass through the charging area over a shorter period of time. Accordingly, in a case in which the intermediate transfer belt 220 changes the moving speed while the toner image passes through the charging area, the pre-transfer charger is preferably controlled so that the charge amount of the toner image may not be changed depending on the moving speed of the intermediate transfer belt 220.

Conductive rollers 241, 242, and 243 are provided between the primary transfer devices 230Bk, 230C, 230M, and 230Y. A recording medium is fed from the paper feed part 140 and conveyed onto a secondary transfer belt 180 via a pair of registration rollers 160. The toner image is transferred from the intermediate transfer belt 220 onto a recording medium by the secondary transfer roller 170 at a contact point of the intermediate transfer belt 220 with the secondary transfer belt 180.

The secondary transfer belt 180 then conveys the recording medium having the toner image thereon to a fixing device 150 to fix the toner image on the recording medium. Residual toner particles remaining on the intermediate transfer belt 220 without being transferred onto the recording medium are removed by an intermediate transfer belt cleaning device 260.

The toner image on the intermediate transfer belt 220 has a negative polarity, which is the same as that of the developing bias voltage, before being transferred onto a recording medium. Therefore, in order to transfer the toner image onto the recording medium, a positive transfer bias voltage may be applied to the secondary transfer roller 170. The pressure in the secondary transfer area makes a large effect on transferability of the toner image. Residual toner particles remaining on the intermediate transfer belt 220 without being transferred onto the recording medium are positively charged due to electric discharge that occurs at the time the recording medium separates from the intermediate transfer belt 220. Residual toner particles from toner images formed when paper jam occurs or those formed on non-image area may keep negative because they are not subjected to the secondary transfer.

In the present embodiment, each of the photoreceptors 210Bk, 210C, 210M, and 210Y includes a photosensitive layer having a thickness of 30 μm, and each of the image writing units 120Bk, 120C, 120M, and 120Y emits a light beam with a beam spot diameter of 50×60 μm and an amount of light of 0.47 mW. The black photoreceptor 210Bk is charged to −700 V by the charger 215Bk and subsequently to −120 V by exposure to light emitted from the image writing unit 120Bk. The developing bias is −470 V. Therefore, the developing potential is 350 V. Toner images formed on the photoreceptors 210Bk, 210C, 210M, and 210Y are transferred onto the intermediate transfer belt 220 by the primary transfer devices 230Bk, 230C, 230M, and 230Y, subsequently transferred from the intermediate transfer belt 220 onto a recording medium by the secondary transfer roller 170, and finally fixed on the recording medium.

Referring to FIG. 8, the developing devices 200Bk, 200C, 200M, and 200Y are connected with the cleaning devices 300Bk, 300C, 300M, and 300Y by toner transport pipes 250Bk, 250C, 250M, and 250Y, respectively. The toner transport pipes 250Bk, 250C, 250M, and 250Y each include a screw, not shown, are configured to transport toner particles which are collected in the cleaning devices 300Bk, 300C, 300M, and 300Y to the developing devices 200Bk, 200C, 200M, and 200Y, respectively.

Generally, so-called direct transfer methods, in which four photoreceptors are brought into direct contact with paper that is conveyed by a belt, has a problem that paper powders adhere to the photoreceptors. At the time of collection of residual toner particles remaining on the photoreceptors, the paper powders are also collected. Therefore, the collected toner particles disadvantageously include the paper powder. When such toner particles are reused for image formation, abnormal images with toner defect may be produced.

Another transfer method using a single photoreceptor and an intermediate transfer body have solved the above-described problem, because the photoreceptor is not brought into direct contact with paper and paper powders do not adhere to the photoreceptor. However, residual toner particles remaining on the single photoreceptor include various-color toner particles, which are difficult to separate. Accordingly, in this transfer method, collected toner particles cannot be reused. There may be a possibility to reuse the collected toner particles as black toner, however, the color tone of black may change depending on printing mode.

In the present embodiment, paper powders are unlikely to be immixed in collected toner particles owing to the intermediate transfer belt 220. Further, paper powders are unlikely to adhere to the intermediate transfer belt 220. Since each of the photoreceptors 210Bk, 210C, 210M, and 210Y is provided along with the respective cleaning devices 300Bk, 300C, 300M, and 300Y, toner particles are reliably collected without color mixing.

Positively-charged toner particles remaining on the intermediate transfer belt 220 may be removed by a conductive fur brush 262 to which a negative voltage is applied. Residual toner particles remaining on the intermediate transfer belt 220 without being transferred onto a recording medium may be also removed by conductive fur brushes 261 and 262. Residual toner particles which are not removed by the conductive fur brush 262, paper powders, and talc may removed by the conductive fur brush 262 to which a negative voltage is applied. In the next process, a black toner image may be transferred from the photoreceptor 210Bk onto the intermediate transfer belt 220 by a positive voltage, negatively-charged toner particles may be attracted to an intermediate transfer belt 220 side, preventing migration to a photoreceptor 210Bk side.

Exemplary embodiments of the intermediate transfer belt 220 are described below. The intermediate transfer belt 220 includes a resin layer, and optionally an elastic layer and a surface layer.

Specific examples of usable resins for the resin layer include, but are not limited to, polycarbonate, fluorocarbon resins (e.g., ETFE, PVDF), homopolymers and copolymers of styrene or styrene derivatives (e.g., polystyrene, chloropolystyrene, poly-α-methylstyrene, styrene-butadiene copolymers, styrene-vinyl chloride copolymers, styrene-vinyl acetate copolymers, styrene-maleic acid copolymers, styrene-acrylate copolymers such as styrene-methyl acrylate copolymers, styrene-ethyl acrylate copolymers, styrene-butyl acrylate copolymers, styrene-octyl acrylate copolymers, and styrene-phenyl acrylate copolymers, styrene-methacrylate copolymers such as styrene-methyl methacrylate copolymers, styrene-ethyl methacrylate copolymers, and styrene-phenyl methacrylate copolymers, styrene-methyl α-chloroacrylate copolymers, styrene-acrylonitrile-acrylate copolymers), methyl methacrylate resins, butyl methacrylate resins, ethyl acrylate resins, butyl acrylate resins, modified acrylic resins (e.g., silicone-modified acrylic resins, vinyl chloride-modified acrylic resins, acrylic-urethane resins), vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene, polypropylene, polybutadiene, polyvinylidene chloride, ionomer resins, polyurethane resins, silicone reins, ketone resins, ethylene-ethyl acrylate copolymers, xylene resins, polyvinyl butyral resins, polyamide resins, and modified polyphenylene oxide resins. These resins can be used alone or in combination.

Specific examples of usable elastic materials for the elastic layer include, but are not limited to, butyl rubbers, fluorine-based rubbers, acrylic rubbers, EPDM, NBR, acrylonitrile-butadiene-styrene rubbers, natural rubbers, isoprene rubbers, styrene-butadiene rubbers, butadiene rubbers, ethylene-propylene rubbers, ethylene-propylene terpolymer, chloroprene rubbers, chlorosulfonated polyethylene, chlorinated polyethylene, urethane rubbers, syndiotactic 1,2-polybutadiene, epichlorohydrin rubbers, silicone rubbers, fluorocarbon rubbers, polysulfide rubbers, polynorbornene rubbers, hydrogenated nitrile rubbers, and thermoplastic elastomers (e.g., polystyrene elastomer, polyolefin elastomer, polyvinyl chloride elastomer, polyurethane elastomer, polyamide elastomer, polyurea elastomer, polyester elastomer, fluorocarbon elastomer). These materials can be used alone or in combination.

The surface layer preferably includes a material capable of reducing adhesion force of toner to intermediate transfer belt so that toner is reliably transferred onto recording medium. Such a material may be a resin or a mixture of resins in which fine particles of one or more of lubricating materials are dispersed, but is not limited thereto. Specific examples of usable resins include, but are not limited to, polyurethane resins, polyester resins, and epoxy resins. Specific examples of usable lubricating materials include, but are not limited to, fluorocarbon resins, fluorine compounds, carbon fluoride, titanium dioxide, and silicon carbide. When multiple lubricating materials are used, the particle diameters thereof are preferably different. A heat-treated fluorine rubber having a fluorine-rich layer on the surface thereof may also be used because of having a small surface energy.

The resin layer and the elastic layer may optionally include a conductive agent for controlling resistance. Specific examples of usable conductive agents include, but are not limited to, carbon black, graphite, powders of metals such as aluminum and nickel, conductive metal oxides such as tin oxide, titanium oxide, antimony oxide, indium oxide, potassium titanate, antimony-tin composite oxide (ATO), and indium-tin composite oxide (ITO). These conductive metal oxides may be covered with insulative particles of barium sulfate, magnesium silicate, calcium carbonate, etc.

FIG. 9 is a schematic view illustrating another exemplary embodiment of an image forming apparatus 100B. The image forming apparatus 100B includes a main body 110, a paper feed table 200 provided below the main body 110, a scanner 300 provided above the main body 110, and an automatic document feeder (ADF) 400 provided above the scanner 300. The main body 110 includes an intermediate transfer member 50, which is an endless belt, in the center thereof.

The intermediate transfer member 50 is stretched taut by support rollers 14, 15, and 16 and rotates clockwise in FIG. 9. An intermediate transfer member cleaning device 17 for removing residual toner particles remaining on the intermediate transfer member 50 is provided on the left side of the support roller 15. Image forming units 18Y, 18C, 18M, and 18K are laterally arranged along the intermediate transfer member 50 between the support rollers 14 and 15. A tandem image forming device 20 is comprised of the image forming units 18Y, 18C, 18M, and 18K.

An irradiator 21 is provided above the tandem image forming device 20. A secondary transfer device 22 is provided on the opposite side of the tandem image forming device 20 relative to the intermediate transfer member 50. The secondary transfer device 22 includes support rollers 23 and a secondary transfer belt 24, which is an endless belt. The secondary transfer belt 24 is stretched taut by the support rollers 23, and is pressed against the support roller 16 with the intermediate transfer member 50 therebetween. A toner image is transferred from the intermediate transfer member 50 onto a sheet of paper there. A fixing device 25 is provided beside the secondary transfer device 22. The fixing device 25 includes a fixing belt 26, which is an endless belt, and a pressing roller 27 that is pressed against the fixing belt 26. The secondary transfer device 22 may have a function of conveying a sheet onto which a toner image is transferred to the fixing device 25. The secondary transfer device 22 may be a transfer roller or a non-contact charger, for example. A sheet reversing device 28 is provided below the secondary transfer device 22 and the fixing device 25 in parallel with the tandem image forming device 20. The sheet reversing device 28 is configured to reverse sheets so that images are recorded on both sides of sheets.

To make a copy, for example, a document may be set on a document table 30. Alternatively, a document may be set on a contact glass 32 of the scanner 300 while lifting up the automatic document feeder 400, and then the document is hold down by the automatic document feeder 400.

Upon pressing of a switch, not shown, in a case in which a document is set on the contact glass 32, the scanner 300 immediately starts driving so that a first runner 33 and a second runner 34 start moving. In a case in which a document is set on the document table 30, the scanner 300 starts driving after the document is fed onto the contact glass 32. The first runner 33 directs a light beam to the document, and reflects a reflected light beam from the document toward the second runner 34. A mirror in the second runner 34 reflects the reflected light beam toward an imaging lens 35. The light beam passed through the imaging lens 35 is then received by a reading sensor 36.

On the other hand, upon pressing of the switch, one of the support rollers 14, 15, and 16 is driven to rotate by a driving motor, not shown. The other two support rollers are also driven to rotate so that the intermediate transfer member 50 is rotated and conveyed. Simultaneously, photoreceptors 10Y, 10C, 10M, and 10K in the respective image forming units 18Y, 18C, 18M, and 18K start rotating, and single-color toner images of yellow, cyan, magenta, and black are formed thereon, respectively. The single-color toner images are successively transferred onto the intermediate transfer member 50 to form a composite full-color toner image.

Upon pressing of the switch, one of paper feed rollers 142 starts rotating in the paper feed table 200 so that a sheet is fed from one of paper feed cassettes 144 in a paper bank 143. The sheet is separated by one of separation rollers 145 and fed to a paper feed path 146. Feed rollers 147 feed the sheet to a paper feed path 148 in the main body 110. The sheet is stopped by a registration roller 49.

Alternatively, a sheet may be provided from a manual feed tray 51 by rotating a paper feed roller 52. The sheet may be separated by a separation roller 58, fed to a manual paper feed path 53, and stopped by the registration roller 49.

The registration roller 49 feeds the sheet to between the intermediate transfer belt 50 and the secondary transfer device 22 in synchronization with an entry of the composite full-color toner image thereto. Thus, the composite full-color toner image (hereinafter the "toner image") is transferred onto the sheet.

The secondary transfer device 22 transfers the sheet having the toner image thereon to the fixing device 25. The toner image is fixed on the sheet by application of heat and pressure in the fixing device 25. The sheet on which the toner image is fixed is switched by a switch pick 55 so as to be discharged onto a discharge tray 57 by rotating a discharge roller 56. Alternatively, the sheet on which the toner image is fixed may be switched by a switch pick 55 so as to be fed to the sheet reversing device 28. In this case, the sheet may be fed to the transfer area again so that an image is formed on the back side of the sheet. The sheet having images on both sides thereof may be discharged onto the discharge tray 57 by rotating the discharge roller 56.

The intermediate transfer member cleaning device 17 removes residual toner particles remaining on the intermediate transfer member 50. The intermediate transfer member 50 prepares for the next image forming by the tandem image forming device 20. The registration roller 49 is typically grounded, however, a bias may be applied thereto for the purpose of removing paper powders.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Measurement of Particle Diameters

Particle diameters and particle diameter distributions of dispersoids in toner components liquids were measured and analyzed using a particle size analyzer MICROTRAC UPA-150 and an analysis software MICROTRAC PARTICLE SIZE ANALYZER Ver. 10.1.2-016EE (both from Nikkiso Co., Ltd.). To prepare a measurement specimen, first, a 30-ml glass container was charged with a toner components liquid, and a solvent used for the toner components liquid was further added thereto so that the resultant dispersion included 10% by weight of dispersoids. The dispersion was then subjected to a dispersion treatment for 2 minutes using an ultrasonic disperser 113MK-II (from Honda Electronics Co., Ltd.). Thus, a measurement specimen was prepared.

First, the solvent used for the toner components liquid was subjected to a measurement of background. Next, the measurement specimen prepared above was dropped therein so that the particle size analyzer indicated a sample loading value of from 1 to 10, and subjected to a measurement of particle diameter distribution. To achieve the above sample loading value, the amount of the measurement specimen dropped in the solvent was controlled appropriately. Measurement and analysis conditions were as follows.

Distribution Display: By Volume
Particle Diameter Classification: Standard
Number of Channels: 44
Measurement Time: 60 sec
Number of Measurements: 1
Particle Permeability: Permeable
Refractive Index of Particles: 1.5
Particle Shape: Non-spherical
Density: 1 g/cm$^3$ The refractive index was listed in a guideline for input conditions for measurements (from Nikkiso Co., Ltd.).

Measurement of BET Specific Surface Area

The BET specific surface areas of toners were measured using a micromeritics automatic surface area and porosimetry analyzer TriStar 3000 (from Shimadzu Corporation). A measurement sell was charged with 1 g of a toner and subjected to a deaerating treatment using VacuPrep 061 (from Shimadzu Corporation) at room temperature for 20 hours under reduced pressures of 100 mtorr or less. The measurement sell was then set to TriStar 3000, and TriStar 3000 automatically measured the BET specific surface area of the toner. The adsorption gas was nitrogen gas.

Preparation of Toner Components Liquid (Synthesis of Unmodified (Low-Molecular-Weight) Polyester) A reaction vessel equipped with a condenser, a stirrer, and a nitrogen inlet pipe was charged with 67 parts of ethylene oxide 2 mol adduct of bisphenol A, 84 parts of propylene oxide 3 mol adduct of bisphenol A, 274 parts of terephthalic acid, and 2 parts of dibutyltin oxide. The mixture was subjected to a reaction for 8 hours at 230° C. under normal pressures, and subsequently for 5 hours at reduced pressures of from 10 to 15 mmHg. Thus, an unmodified polyester was prepared.

The unmodified polyester had a number average molecular weight (Mn) of 2,100, a weight average molecular weight (Mw) of 5,600, and a glass transition temperature (Tg) of 55° C.

(Preparation of Master Batch)

First, 1,000 parts of water, 540 parts of a carbon black (PRINTEX 35 from Degussa, having a DBP oil absorbing value of 42 ml/100 g and a pH of 9.5), and 1,200 parts of the unmodified polyester prepared above were mixed using a HENSCHEL MIXER (from Mitsui Mining Co., Ltd.). The mixture was kneaded with a double-roll mill for 30 minutes at 150° C., followed by rolling and cooling. The mixture was then pulverized into particles using a pulverizer (from Hosokawa Micron Corporation). Thus, a master batch was prepared.

(Synthesis of Prepolymer)

A reaction vessel equipped with a condenser, a stirrer, and a nitrogen inlet pipe was charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture was subjected to a reaction for 8 hours at 230° C. under normal pressures, and subsequently for 5 hours at reduced pressures of from 10 to 15 mmHg. Thus, an intermediate polyester was prepared.

The intermediate polyester had a number average molecular weight (Mn) of 2,100, a weight average molecular weight (Mw) of 9,600, a glass transition temperature (Tg) of 55° C., an acid value of 0.5 mgKOH/g, and a hydroxyl value of 49 mgKOH/g.

Next, a reaction vessel equipped with a condenser, a stirrer, and a nitrogen inlet pipe was charged with 411 parts of the intermediate polyester, 96 parts of isophorone diisocyanate, and 500 parts of ethyl acetate. The mixture was subjected to a reaction for 5 hours at 100° C. Thus, a prepolymer (i.e., a polymer reactive with a compound having an active hydrogen group) was prepared. The prepolymer included free isocyanates in an amount of 1.60% by weight. The prepolymer which was left for 45 minutes at 150° C. included solid components in an amount of 50%.

(Preparation of Toner Components Liquid)

A beaker was charged with 100 parts of the unmodified polyester and 130 pars of ethyl acetate. The mixture was agitated so that the unmodified polyester was dissolved in the ethyl acetate. Further, 10 parts of a carnauba wax (having a molecular weight of 1,800, an acid value of 2.5 mgKOH/g, and a penetration of 1.5 mm at 40° C.) and 10 parts of the master batch were added thereto. The mixture was subjected to a dispersion treatment using a bead mill (ULTRAVIS-COMILL (trademark) from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Finally, 40 parts of the prepolymer were further added to the mixture. Thus, a toner components liquid was prepared.

Preparation of Particulate Resin A

A reaction vessel equipped with a stirrer and a thermometer was charged with 683 parts of water, 16 parts of a sodium salt of sulfate of ethylene oxide adduct of methacrylic acid (ELEMINOL RS-30 from Sanyo Chemical Industries, Ltd.), 83 parts of styrene, 83 parts of methacrylic acid, 110 parts of butyl acrylate, and 1 parts of ammonium persulfate. The mixture was agitated for 15 minutes at a revolution of 400 rpm. Thus a whitish emulsion was prepared. The emulsion was heated to 75° C. and reacted for 5 hours. Subsequently, 30 parts of a 1% aqueous solution of ammonium persulfate were added to the emulsion, and aged for 5 hours at 75° C. Thus, a particulate resin dispersion A1, which was an aqueous dispersion of a vinyl resin A1 (i.e., a copolymer of styrene, methacrylic acid, butyl acrylate, and a sodium salt of sulfate of ethylene oxide adduct of methacrylic acid), was prepared. Particles of the vinyl resin A1 in the particulate resin dispersion A1 had a volume average particle diameter of 9 nm, measured by LA-920 (from Horiba, Ltd.).

Preparation of Particulate Resin B

A reaction vessel equipped with a stirrer and a thermometer was charged with 683 parts of water, 10 parts of distearyl dimethyl ammonium chloride (CATION DS from Kao Corporation), 138 parts of styrene, 138 parts of methyl methacrylate, 1 parts of ammonium persulfate, and 1 part of 1,6-hexanediol diacrylate (V#230 from Osaka Organic Chemical Industry Ltd.). The mixture was agitated for 15 minutes at a revolution of 400 rpm. Thus a whitish emulsion was prepared. The emulsion was heated to 65° C. and reacted for 10 hours. Subsequently, 30 parts of a 1% aqueous solution of ammonium persulfate were added to the emulsion, and aged for 5 hours at 75° C. Thus, a particulate resin dispersion B1, which was an aqueous dispersion of a vinyl resin B1 (i.e., a copolymer of styrene and methyl methacrylate), was prepared. Particles of the vinyl resin B1 in the particulate resin dispersion B1 had a volume average particle diameter of 18 nm, measured by LA-920 (from Horiba, Ltd.).

The above procedure was repeated except for changing the amount of the 1,6-hexanediol diacrylate (V#230 from Osaka Organic Chemical Industry Ltd.) to 0.5 parts, 2 parts, and 0 part to prepare particulate resin dispersions B2, B3, and B4, respectively.

Evaluation of Swelling Property of Particulate Resin B

To evaluate swelling property of the particulate resins B1 to B4, each of the particulate resin dispersions B1 to B4 was dropped in a 30-ml screw vial (from As One Corporation) using a measuring pipette to have a depth of 20 mm from the bottom of the screw vial. Further, 10 ml of ethyl acetate were added thereto using a measuring pipette. After being left for 24 hours, the mixture was phase-separated into a whitish particulate resin dispersion phase on the lower side and an ethyl acetate phase on the upper side. Swelling property was evaluated by measuring the height of the whitish particulate resin dispersion phase from the bottom of the screw vial. The greater the height of the whitish particulate resin dispersion phase, the higher the swelling property. The swelling property was graded by the height thus measured as follows.

A: 25 mm or more (swells sufficiently)

B: 21 mm or more and less than 25 mm (swells)

C: 20 mm or more and less than 21 mm (swells insufficiently)

D: less than 20 mm (does not swell)

The swelling property, compatibility with binder resin, and volume average particle diameter of the particulate resins B1 to B4 are shown in Table 1.

TABLE 1

| Particulate Resin | Swelling Property | Compatibility with Binder Resin | Volume Average Particle Diameter (nm) |
|---|---|---|---|
| B1 | B | Incompatible | 18 |
| B2 | A | Incompatible | 42 |
| B3 | B | Incompatible | 108 |
| B4 | D | Incompatible | 193 |

Toner Example 1

(Preparation of Aqueous Medium)

First, 660 parts of water, 25 parts of the particulate resin dispersion A1, 25 parts of a 48.5% aqueous solution of dodecyl diphenyl ether sodium disulfonate (ELEMINOL MON-7 from Sanyo Chemical Industries, Ltd.), and 60 parts of ethyl acetate were mixed and agitated. Further, 50 parts of the particulate resin dispersion B1 was added to the resultant whitish liquid. It was observed by an optical microscope that the mixture liquid included aggregations with a size of several hundred micrometers. The mixture was agitated at a revolution of 8,000 rpm using a TK HOMOMIXER (from PRIMIX Corporation) to loose the aggregations. As a result, it was observed by an optical microscope that the aggregations were split into small aggregations with a size of several micrometers. Thus, an aqueous medium was prepared.

The aggregations of the particulate resin B1 were loosen by application of shearing force, as described above, so that the particulate resin B1 uniformly adhere to liquid droplets of the toner component liquid.

(Preparation of Emulsion Slurry)

Next, 150 parts of the aqueous medium was contained in a container and agitated at a revolution of 12,000 rpm using a TK HOMOMIXER (from PRIMIX Corporation). Further, 100 parts of the toner components liquid was added thereto and mixed for 10 minutes. Thus, an emulsion slurry was prepared.

(Removal of Organic Solvent)

A flask equipped with a deaerating tube, a stirrer, and a thermometer was charged with 100 parts of the emulsion slurry. The emulsion slurry was agitated at a revolution of 20 m/min at 30° C. for 12 hours under reduced pressures so that the organic solvent was removed therefrom. The resultant deaerated slurry was then heated to 60° C. so that the particulate resin B1 was fixed on the resultant toner particles.

(Washing and Drying)

The deaerated slurry was filtered under reduced pressures to obtain a wet cake. The wet cake was mixed with 300 parts of ion-exchange water and the mixture was agitated for 10 minutes using a TK HOMOMIXER at a revolution of 12,000 rpm, followed by filtering. Thus, a wet cake (i) was prepared.

The wet cake (i) was mixed with 300 parts of ion-exchange water and the mixture was agitated for 10 minutes using a TK HOMOMIXER at a revolution of 12,000 rpm, followed by filtering. This operation was repeated 3 times. Thus, a wet cake (ii) was prepared.

The wet cake (ii) was dried for 48 hours at 45° C. using a circulating air drier, followed by sieving with a screen having openings of 75 μm. Thus, a mother toner (a) was prepared.

(Preparation of Toner)

Finally, 100 parts of the mother toner (a) was mixed with 0.6 parts of a hydrophobized silica having an average particle diameter of 100 nm, 1.0 part of a titanium oxide having an average particle diameter of 20 nm, and 0.8 parts of a hydrophobized silica having an average particle diameter of 15 nm using a HENSCHEL MIXER. Thus, a toner (a) was prepared.

Toner Example 2

The procedure for preparation of the toner (a) was repeated expect for replacing the particulate resin dispersion B1 with the particulate resin dispersion B2. Thus, a toner (b) was prepared.

The particulate resin B2 was incompatible with the binder resin and had high swelling property. It was observed by an optical microscope that the particulate resin B2 formed aggregations with a size of several hundred micrometers in an aqueous medium. Therefore, the aqueous medium was agitated at a revolution of 8,000 rpm using a TK HOMOMIXER (from PRIMIX Corporation) to loose the aggregations. As a result, it was observed by an optical microscope that the aggregations were split into small aggregations with a size of several micrometers. Accordingly, the particulate resin B2 uniformly adhered to liquid droplets of the toner component liquid.

Toner Example 3

The procedure for preparation of the toner (a) was repeated expect for replacing the particulate resin dispersion B1 with the particulate resin dispersion B3. Thus, a toner (c) was prepared.

The particulate resin B3 was incompatible with the binder resin and had high swelling property. It was observed by an optical microscope that the particulate resin B3 formed aggregations with a size of several hundred micrometers in an aqueous medium. Therefore, the aqueous medium was agitated at a revolution of 8,000 rpm using a TK HOMOMIXER (from PRIMIX Corporation) to loose the aggregations. As a result, it was observed by an optical microscope that the aggregations were split into small aggregations with a size of several micrometers. Accordingly, the particulate resin B3 uniformly adhered to liquid droplets of the toner component liquid.

Toner Example 4

The procedure for preparation of the toner (a) is repeated expect for replacing the 48.5% aqueous solution of dodecyl diphenyl ether sodium disulfonate (ELEMINOL MON-7 from Sanyo Chemical Industries, Ltd.) with a 48.5% aqueous solution of a polyoxyethylene lauryl ether (EMULGEN 123P from Kao Corporation). Thus, a toner (d) is prepared.

The polyoxyethylene lauryl ether is a while solid having an HLB of 16.9. It is observed by an optical microscope that the particulate resin B1 does not form aggregation in an aqueous medium including the polyoxyethylene lauryl ether.

Comparative Toner Example 1

The procedure for preparation of the toner (a) was repeated expect for replacing the particulate resin dispersion B1 with the particulate resin dispersion B4. Thus, a toner (e) was prepared.

The particulate resin B4 was incompatible with the binder resin and exhibited no swelling property. It was observed by an optical microscope that the particulate resin B4 formed aggregations with a size of several hundred micrometers in an aqueous medium. Therefore, the aqueous medium was agitated at a revolution of 8,000 rpm using a TK HOMOMIXER (from PRIMIX Corporation) to loose the aggregations. As a result, it was observed by an optical microscope that the aggregations were split into small aggregations with a size of several micrometers. Accordingly, the particulate resin B4 uniformly adhered to liquid droplets of the toner component liquid.

Comparative Toner Example 2

(Preparation of Resin containing No Solvent)

A monomer mixture in which 100 parts of styrene and 0.5 parts of di-tertiary-butyl-peroxide are uniformly mixed is continuously added to an autoclave equipped with a stirrer, a heater, a cooler, a thermometer, and a dropping pump, controlled to a temperature of 210° C., over a period of 30 minutes. The monomer mixture is left for 30 minutes at 210° C. so that residual monomers are removed. Thus, a resin containing no solvent (hereinafter "no-solvent resin") is prepared. The no-solvent resin has a peak molecular weight (Mp) of 4,500 and a weight average molecular weight (Mw) of 5,100.

(Preparation of Resin Emulsion)

A container equipped with a stirrer and a dropping pump is charged with 27 parts of deionized water and 1 part of an anionic emulsifier (NEOGEN R from Kao Corporation). The mixture is agitated so that the anionic emulsifier is dissolved in the deionized water. A monomer mixture including 75 parts of styrene, 25 parts of butyl acrylate, and 0.05 parts of divinylbenzene is further mixed therein and agitated. Thus, a monomer emulsion is prepared.

Next, a pressure-resistant reaction vessel equipped with a stirrer, a manometer, a thermometer, and a dropping pump is charged with 120 parts of deionized water and substituted with nitrogen. The reaction vessel is heated to 80° C. and 5% by weight of the monomer emulsion prepared above and 1 part of a 2% aqueous solution of potassium persulfate are added thereto. Thus, an initial polymerization is performed at 80° C. After termination of the initial polymerization, the mixture is heated to 85° C. and the remaining monomer emulsion and 4 parts of the 2% aqueous solution of potassium persulfate are further added thereto. The mixture is left for 2 hours at 85° C. Thus, a styrene resin emulsion including 40% of resin particles having a particle diameter of 0.15 μm is prepared.

The resultant resin emulsion is reliably formed at a high polymerization conversion ratio. The resultant resin separated by centrifugal separation has a weight average molecular weight (Mw) of 950,000 and a peak molecular weight (Mp) of 700,000.

(Preparation of No-Solvent Resin Composition)

First, 100 parts of the no-solvent resin which is melted at 210° C. and 135 parts of the resin emulsion are continuously mixed using a PADDLE DRYER (having a void ratio of about 70%, from Nara Machinery Co., Ltd.) at a jacket temperature of 200° C. for 20 minutes, while water are removed by evaporation. Thus, a no-solvent resin composition including water in an amount of 0.1% or less is prepared. The no-solvent resin composition includes residual monomers in an amount of 100 ppm.

(Preparation of Toner)

The procedure for preparation of the toner (a) is repeated expect for replacing the unmodified polyester with the no-solvent resin composition. Thus, a toner (f) is prepared.

The particulate resin B1 is compatible with the no-solvent resin composition and exhibits no swelling property.

Properties of the toners (a) to (f) are shown in Table 2.

TABLE 2

| | Toner | Particulate Resin A | Particulate Resin B | Circularity | BET Specific Surface Area ($m^2/g$) |
|---|---|---|---|---|---|
| Ex. 1 | (a) | A1 | B1 | 0.967 | 1.5 |
| Ex. 2 | (b) | A1 | B2 | 0.952 | 1.6 |
| Ex. 3 | (c) | A1 | B3 | 0.972 | 3.8 |
| Ex. 4 | (d) | A1 | B1 | 0.967 | 1.5 |
| Comp. Ex. 1 | (e) | A1 | B4 | 0.974 | 4.0 |
| Comp. Ex. 2 | (f) | A1 | B1 | 0.975 | 3.8 |

Preparation of Carrier

To prepare a coating liquid, 21.0 parts of an acrylic resin solution (including solid components in an amount of 50%), 6.4 parts of a guanamine solution (including solid components in an amount of 70%), 7.6 parts of alumina particles (having an average particle diameter of 0.3 μm and a specific resistance of $10^{14}$ Ω·cm), 65.0 parts of a silicone resin solution (SR2410 from Dow Coming Toray Co., Ltd., including solid components in an amount of 23%), 1.0 part of aminosilane (SH6020 from Dow Coming Toray Co., Ltd., including solid components in an amount of 100%), 60 parts of toluene, and 60 parts of butyl cellosolve were subjected to a dispersion treatment for 10 minutes using a homomixer. The above-prepared coating liquid was coated on particles of a calcined ferrite ($(MgO)_{1.8}(MnO)_{49.5}(Fe_2O_3)_{48.0}$ having an average particle diameter of 25 μm) using a SPIRA COTA® (from Okada Seiko Co., Ltd.) so that the resultant coating layer had a thickness of 0.15 μm, followed by drying. The coated ferrite particles were calcined in an electric furnace at 150° C. for 1 hour, followed by cooling. A bulk of the calcined ferrite particles was then sieved with a mesh having openings of 106 μm. Thus, a carrier (A) having a weight average particle diameter of 35 μm was prepared.

The thickness of the coating layer was measured by observing a cross section of the carrier particle using a transmission electron microscope (TEM).

Preparation of Two-Component Developers

To prepare two-component developers (a) to (f), 7 parts of each of the toners (a) to (f) and 100 parts of the carrier (A) was uniformly mixed using a TURBULA® MIXER.

Evaluations (1) Transfer Efficiency (%)

An image forming apparatus DOCUCOLOR 8000 DIGITAL PRESS (from Fuji Xerox Co., Ltd.) was modified to have a linear speed of 162 mm/sec and a transfer time of 40 msec. Each of the developers (a) to (f) was mounted on the above image forming apparatus, and a running test in which a solid image including a toner in an amount of 0.6 $mg/cm^2$ is continuously formed on an A4-size sheet of paper was performed. In the initial stage of the running test and after the $100{,}000^{th}$ image was produced, the primary transfer efficiency and the secondary transfer efficiency were calculated from the following equations (5) and (6), respectively.

$$TE1(\%)=T/D \quad (5)$$

$$TE2(\%)=T-R/T \quad (6)$$

wherein TE1 and TE2 represent primary and secondary transfer efficiencies, respectively; D represents an amount of toner particles developed on a photoreceptor; T represents an amount of toner particles transferred onto an intermediate transfer member; and R represents an amount of residual toner particles remaining on the intermediate transfer member.

The primary and secondary transfer efficiencies are averaged and graded as follows.

A: 90% or more
B: 85% or more and less than 90%
C: 80% or more and less than 85%
D: less than 80%

(2) Minimum Fixable Temperature

A full-color image forming apparatus IMAGIO NEO C600 PRO (from Ricoh Co., Ltd.) was modified so that the temperature and linear speed of the fixing device were variable. A solid image including a toner in an amount of 0.85±0.1 $mg/cm^2$ was formed on a thick paper <135> (from Ricoh Co., Ltd.). A temperature of the fixing roller below which the residual rate of the fixed toner image after being rubbed with a pad is 70% or more was defined as the minimum fixable temperature. The minimum fixable temperature was graded as follows.

A: less than 120° C.
B: less than 140° C. and 120° C. or more
C: less than 160° C. and 140° C. or more
D: 160° C. or more (2) Maximum Fixable Temperature A full-color image forming apparatus IMAGIO NEO C600 PRO (from Ricoh Co., Ltd.) was modified so that the temperature and linear speed of the fixing device are variable. A solid image including a toner in an amount of 0.85±0.3 $mg/cm^2$ was formed on a normal paper TYPE 6000 <70W> (from Ricoh Co., Ltd.). A temperature of the fixing roller above which hot offset occurs was defined as the maximum fixable temperature. The maximum fixable temperature was graded as follows.

A: 210° C. or more
B: less than 210° C. and 190° C. or more
C: less than 190° C. and 170° C. or more
D: less than 170° C.

The results are shown in Table 3.

TABLE 3

| | | Transfer Efficiency | | Fixable Temperature | |
|---|---|---|---|---|---|
| | Toner | Initial Stage | After $100{,}000^{th}$ image | Minimum | Maximum |
| Ex. 1 | (a) | A | A | A | A |
| Ex. 2 | (b) | A | A | A | A |

TABLE 3-continued

| | | Transfer Efficiency | | Fixable Temperature | |
|---|---|---|---|---|---|
| | Toner | Initial Stage | After 100,000th image | Minimum | Maximum |
| Ex. 3 | (c) | A | C | A | A |
| Ex. 4 | (d) | B | C | A | A |
| Comp. Ex. 1 | (e) | C | D | A | A |
| Comp. Ex. 2 | (f) | C | D | D | D |

This document claims priority and contains subject matter related to Japanese Patent Application No. 2008-168191, filed on Jun. 27, 2008, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, produced by a method comprising:

dissolving or dispersing toner components comprising a colorant and at least one of a the binder resin and a precursor thereof in the organic solvent to prepare a toner components liquid;

dispersing the toner components liquid in an aqueous medium including a surfactant, a particulate resin A having the same polarity as the surfactant and a volume average particle diameter of from 5 to 25 nm, and a particulate resin B having a volume average particle diameter of from 10 to 500 nm to form liquid droplets, wherein the average particle diameter of particulate resin A is smaller than the average particle diameter of particulate resin B; and removing the organic solvent from the liquid droplets, wherein the binder resin comprises a polyester resin;

wherein the particulate resin A comprises a vinyl resin; and wherein the particulate resin B comprises fine particles of a cross-linked resin comprising at least one of a styrene polymer, an acrylate polymer, and a methacrylate polymer, wherein the particulate resin B is incompatible with the binder resin and is swellable in an organic solvent, wherein the particulate resins A and B adhere to a surface of the toner, wherein when the particulate resin B is dropped into a 30-ml screw vial using a measuring pipette to have a depth of 20 mm from the bottom of the screw vial, 10 ml of ethyl acetate are further added thereto using a measuring pipette, and the screw vial is left for 24 hours so that a mixture of the particulate resin B and the ethyl acetate is phase-separated into a whitish particulate resin B dispersion phase on a lower side and an ethyl acetate phase on an upper side, a height of the whitish particulate resin B dispersion phase from the bottom of the screw vial is 21 mm or more.

2. The toner according to claim 1, wherein the precursor comprises a compound (A) having an active hydrogen group and a polymer (B) having a site reactive with an active hydrogen group, and the polymer (B) reacts with the compound (A) having an active hydrogen group to form the binder resin after the toner components liquid is dispersed in the aqueous medium.

3. The toner according to claim 2, wherein the polymer (B) having a site reactive with an active hydrogen group is a modified polyester resin having a site reactive with an active hydrogen group.

4. The toner according to claim 2, wherein the particulate resin A is selected from the group consisting of styrene-(meth)acrylate copolymers, styrene-butadiene copolymers, (meth)acrylate-acrylate copolymers, styrene-acrylonitrile copolymers, styrene-maleic anhydride copolymers, and styrene-(meth)acrylic acid copolymers.

5. The toner according to claim 1, wherein the surfactant is an anionic surfactant.

6. The toner according to claim 5, wherein the particulate resin B aggregates in the aqueous medium including the anionic surfactant.

7. The toner according to claim 1, wherein the binder resin consists of a polyester resin.

8. The toner according to claim 1, wherein the toner components further comprise a release agent.

9. The toner according to claim 1, wherein the toner has a weight average particle diameter of from 1 to 6 μm.

10. The toner according to claim 1, wherein the particulate resin B comprises a styrene-acrylic resin.

11. The toner according to claim 1, wherein the toner has an average circularity of from 0.95 to 0.99.

12. The toner according to claim 1, wherein the toner has a specific surface area of from 0.2 to 4.0 $m^2/g$.

13. The toner according to claim 1, wherein the particulate resin A is anionic.

14. The toner according to claim 1, wherein the particulate resin A contains carboxylic acid groups or sulfonic acid groups.

15. The toner according to claim 1, wherein when the particulate resin B is dropped into a 30-ml screw vial using a measuring pipette to have a depth of 20 mm from the bottom of the screw vial, 10 ml of ethyl acetate are further added thereto using a measuring pipette, and the screw vial is left for 24 hours so that a mixture of the particulate resin B and the ethyl acetate is phase-separated into a whitish particulate resin B dispersion phase on a lower side and an ethyl acetate phase on an upper side, a height of the whitish particulate resin B dispersion phase from the bottom of the screw vial is 25 mm or more.

16. An image forming method, comprising:

charging one or more electrophotographic photoreceptors;

irradiating the one or more charged electrophotographic photoreceptors to form one or more electrostatic latent images;

developing the one or more electrostatic latent images with the toner according to claim 1 to form one or more toner images;

transferring the one or more toner images from the one or more electrophotographic photoreceptors onto an intermediate transfer member;

transferring the one or more toner images from the intermediate transfer member onto a recording medium;

fixing the one or more toner images on the recording medium by application of heat and pressure; and removing residual toner particles remaining on the electrophotographic photoreceptor without being transferred onto the intermediate transfer member.

17. The image forming method according to claim 16, wherein the one or more toner images are transferred from the intermediate transfer member onto the recording medium at a linear speed of from 100 to 1,000 mm/sec and a transfer time of from 0.5 to 60 msec.

18. The image forming method according to claim 16, wherein the number of the electrophotographic photoreceptors is two or more.

* * * * *